US007442058B2

(12) United States Patent
Ohtaka et al.

(10) Patent No.: US 7,442,058 B2
(45) Date of Patent: Oct. 28, 2008

(54) LEVER-TYPE CONNECTOR WITH LOCKING ARM

(75) Inventors: Kazuto Ohtaka, Shizuoka (JP); Hideki Ohsumi, Shizuoka (JP); Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/405,439

(22) Filed: Apr. 18, 2006

(65) Prior Publication Data

US 2006/0234535 A1 Oct. 19, 2006

(30) Foreign Application Priority Data

Apr. 18, 2005 (JP) ..... 2005-120156
Feb. 8, 2006 (JP) ..... 2006-031547

(51) Int. Cl.
*H01R 13/62* (2006.01)

(52) U.S. Cl. ..... 439/157

(58) Field of Classification Search ..... 439/157, 439/357, 358
See application file for complete search history.

(56) References Cited

U.S. PATENT DOCUMENTS 5,344,194 A * 9/1994 Hatagishi et al. ..... 285/26
6,361,337 B2 * 3/2002 Kurimoto ..... 439/157
6,558,176 B1 5/2003 Martin et al.
6,602,082 B2 * 8/2003 Nishide et al. ..... 439/157
6,638,085 B1 10/2003 Martin
6,648,658 B2 * 11/2003 Okabe et al. ..... 439/157
6,692,274 B2 * 2/2004 Maegawa ..... 439/157
2004/0132327 A1 7/2004 Minota

FOREIGN PATENT DOCUMENTS

DE 102 13 486 10/2002
DE 102 56 676 6/2003
DE 601 04 743 8/2005
JP 2002-359028 12/2002
JP 2003-92169 3/2003

OTHER PUBLICATIONS

The Search Report issued by the Bitish Patent Office for corresponding British patent application GB0607634.3, dated Jul. 28, 2006. (Citing References AA-AC).
Communication received from the German Patent Office mailed Mar. 12, 2008 with English translation (6 pages).

* cited by examiner

*Primary Examiner*—Renee S Luebke
*Assistant Examiner*—Vanessa Girardi
(74) *Attorney, Agent, or Firm*—Kratz, Quintos & Hanson, LLP

(57) ABSTRACT

A set of lever-type connectors, which can be miniaturized. The set of connectors includes a male connector, a female connector and a lever mounted rotatably on the male connector. The connectors are coupled and uncoupled by rotating the lever. A lock arm is provided on the male connector and a lock projection, engaging with the lock arm, is provided on the female connector.

11 Claims, 21 Drawing Sheets

(a)

(b)

(a)

(b)

LEVER-TYPE CONNECTOR WITH LOCKING ARM

The priority application, Japan Patent Application Number 2006-031547, upon which this patent application is based, is hereby incorporated by reference.

BACKGROUND OF THE INVENTION

1. Field of the Invention

This invention relates to a set of connectors, to be fitted to each other, including a first connector, a second connector and a lever mounted rotatably on one of the connectors.

2. Description of the Related Art

A lever-type connector, which has a lever, is known (for example References see below).

FIG. 22 is a cross-sectional view showing a male housing and a female housing of a lever-type connector disclosed in the Patent document 1 before fitting them together. FIG. 23 is a cross-sectional view showing a condition in which the male housing is fitted into the female housing which are shown in FIG. 22.

According to the lever-type connector 100 in FIGS. 22, 23, a lever 101 is engaged at an engaging hole 102, provided at the lever 101, with a projection 104 of a male housing 103 and supported rotatably around a projection 104 on the male housing 103.

The lever 101 rotates on the male housing 103 so as to make the female housing 105 and male housing 103 couple to each other and fit together. In other words, with rotation of the lever 101, the male housing 103 is received into a hood 106 of the female housing 105. By engaging a lock projection 107 of the hood 106 with a lock (not shown) of the lever 101, the lever 101 is locked. Thus, the lever 101 is locked so that fitting of the housings 103, 105 is maintained. When the lever 101 of the above lever-type connector 100 is not used, it is very difficult to fit the housings 103, 105 to each other. In other words, for fitting the housings 103, 105 couple to each other, a strong force for making the housings 103, 105 couple to each other is required.

References are Japan Patent Published No. 2002-359028 and 2003-92169.

SUMMARY OF THE INVENTION

Objects to be Solved

The usual lever-type connector 100, as shown in FIGS. 22, 23, cannot be provided in a narrow space where the lever 101 cannot be arranged, since the lever 101 maintains coupling of the housings 103, 105. If the lever 101 is eliminated, the coupling of the connectors 103, 105 cannot be maintained.

In the aforesaid lever-type connector 100, since the lever 101 maintains coupling of the housings 103, 105, the coupling of the housings 103, 105 cannot be maintained when the lever 101 is broken. Therefore, design of a mechanically strong lever requires that the lever 101 be enlarged. Thus, the aforesaid lever-type connector 100 is required to have a relatively large lever 101, which has enough mechanical strength not to be broken if another object hits the lever 101. Therefore, space for providing the lever 101 is enlarged.

To overcome the above problems, an object of this invention is to provide a connector including a lever, which can be miniaturized.

In order to attain the objects of the present invention, a set of connectors includes a first connector having a lock arm; a second connector having a lock projection to be engaged with the lock arm and coupling with the first connector by engaging the lock projection and the lock arm; a lever provided rotatably on either one of the first connector and the second connector so as to rotate for moving the first connector and the second connector in a coupling direction to be closer to each other or in an uncoupling direction to be further apart from each other; an interlocking release member for releasing an engagement of the lock arm and the lock projection by operating with a rotation of the lever when separating the first connector and the second connector from each other; and a fitting hold spacing to hold the first connector and the second connector together until the engagement of the lock arm and the lock projection is released even if the lever rotates.

The set of connectors is further characterized in the set of connectors mentioned above in that one end of the lock arm is connected to the first connector and the other end of the lock arm has a free end to be engaged with the lock projection of the second connector, and the interlocking release member includes a second release member provided at the lever for deforming elastically the lock arm so as to release the engagement of the lock arm and the lock projection by pushing the one end of the lock arm toward the first connector when the lever is rotated when the connectors are in a condition that the first connector and the second connector are coupled together.

The set of connectors is further characterized in the set of connectors mentioned above in that one end of the lock arm is connected to the first connector and the other end of the lock arm has a free end to be engaged with the lock projection of the second connector, and the interlocking release member includes a second release member provided at the lever for deforming elastically the lock arm so as to release the engagement of the lock arm and the lock projection by pushing the one end of the lock arm toward the first connector when the lever is rotated in a manner that the first connector and the second connector are coupled together.

The set of connectors is further characterized in the set of connectors mentioned above in that the second release member includes a pushing portion projecting from the lever toward the lock arm, and a guide groove provided at the lock arm and extending in a direction of moving the first connector and the second connector in the coupling and uncoupling direction for providing guiding motion to the pushing portion to penetrate into the guide groove when the lever is rotated.

The set of connectors is further characterized in the set of connectors mentioned above in that either one of the first connector and the second connector, on which the lever is provided, is provided with a pair of guide projections extending in the direction of moving the first connector and the second connector in the coupling and uncoupling directions for providing guiding motion to the pushing portion to penetrate between the pair of guide projections when the lever is rotated.

The set of connectors is further characterized in the set of connectors mentioned above in that a fitting guide projection is provided on the lever of the connector on which the lever is provided, and the fitting guide projection projects toward the other of the connectors, and a fitting guide groove, into which the fitting projection penetrates, is provided on the other of the connectors, and the first connector and the second connector are moved in the coupling and uncoupling directions by moving the fitting guide projection in the fitting guide groove when the lever is rotated, and the fitting hold spacing is formed with a space arranged between the fitting guide projection and the fitting guide groove so as to maintain the space between the fitting guide projection and the fitting guide groove until the interlocking release member releases the engagement of the lock arm and the lock projection.

The set of connectors is further characterized in the set of connectors mentioned above in that a temporary lock is provided for locking the lever when the first connector and the second connector are uncoupled, and releasing a locking of the temporary lock with approaching of the first and second connectors to each other when the first and second connectors are coupled.

According to the invention, since the first connector and the second connector can be maintained to be coupled to each other without providing the lever, after coupling the connectors to each other by using the lever, the lever can be removed and if the lever is broken, the connectors can be maintained to be coupled together.

Therefore, mechanical strength of the lever can be reduced for miniaturizing the lever so that the connectors can also be miniaturized. The set of connectors according to the present invention can be used even if the lever is removed. Therefore, a space for accommodating the set of connectors can be miniaturized and the set of connectors can be used in a narrow space.

Since the interlocking release member releases the engagement of the lock arm and the lock projection with rotation of the lever, the connectors can be uncoupled from each other by rotation of the lever. Therefore, the connectors can be uncoupled easily without damage of the lock arm and the lock projection.

Before the engagement of the lock arm and the lock projection is released when the connectors are uncoupled, the connectors can be prevented from uncoupling. Thereby, the lock arm and the lock projection can be prevented from damage. Therefore, the connectors can be uncoupled easily without damage of the lock arm and the lock projection.

According to the invention, since the first release member of the interlocking release member penetrates between the free end of the lock arm and the first connector, the engagement of the lock arm and the lock projection can be released easily.

According to the invention, since the second release member of the interlocking member pushes the one end of the lock arm toward the first connector, the engagement of the lock arm and the lock projection can be released easily.

According to the invention, since the rotation of the lever is guided by the second release member and the guide groove, even if the mechanical strength of the lever is reduced for miniaturizing the lever, the lever will not be damaged. Therefore, the connectors can be moved in the coupling and uncoupling directions easily by rotating the lever.

According to the invention, since the rotation of the lever is guided by the second release member and the pair of guide projections, even if the mechanical strength of the lever is reduced for miniaturizing the lever, the lever will not be damaged. Therefore, the connectors can be moved in the coupling and uncoupling directions easily by rotating the lever.

According to the invention, since the fitting hold spacing is formed with a space arranged between the fitting guide projection and the fitting guide groove, the fitting hold spacing prevents the first connector and the second connector from moving relative to each other, until the engagement of the lock arm and the lock projection is released. Therefore, the connectors can be uncoupled easily without damage of the lock arm and the lock projection.

According to the invention, since the temporary lock is provided, the lever is prevented from rotating when the first connector and the second connector are uncoupled. When the connectors are uncoupled, the lever can be prevented from rotating to a position where the lever is positioned when coupling the connectors together.

The above and other objects and features of this invention will become more apparent from the following description taken in conjunction with the accompanying drawings.

DESCRIPTION OF THE PREFERRED EMBODIMENT

A set of connectors of an embodiment according to the present invention will be described with reference to FIGS. 1-21.

Figure 1:
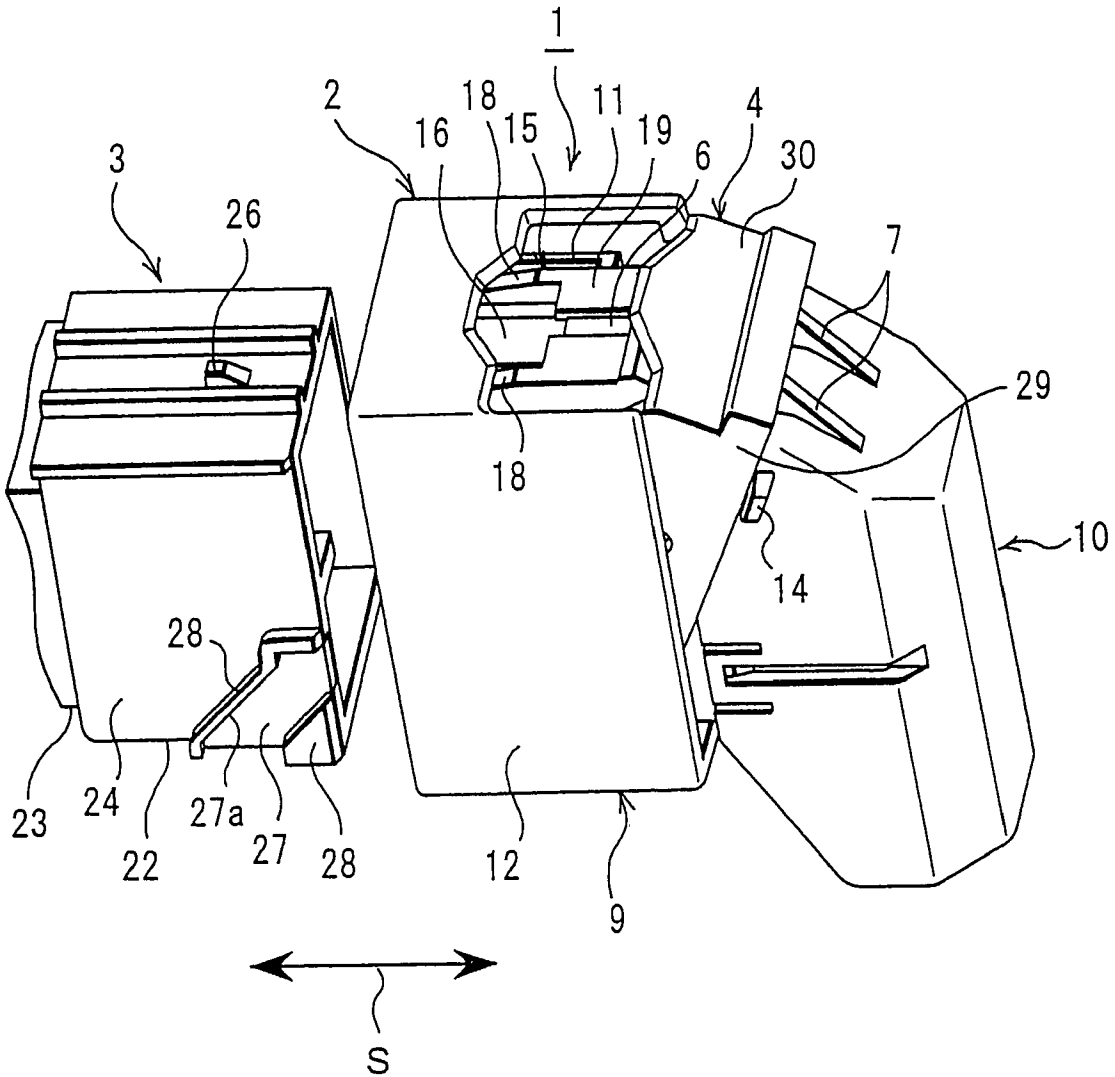
FIG. 1 is a perspective view of a female connector and a male connector before coupling a set of connectors of an embodiment of the present invention.
Figure 2:
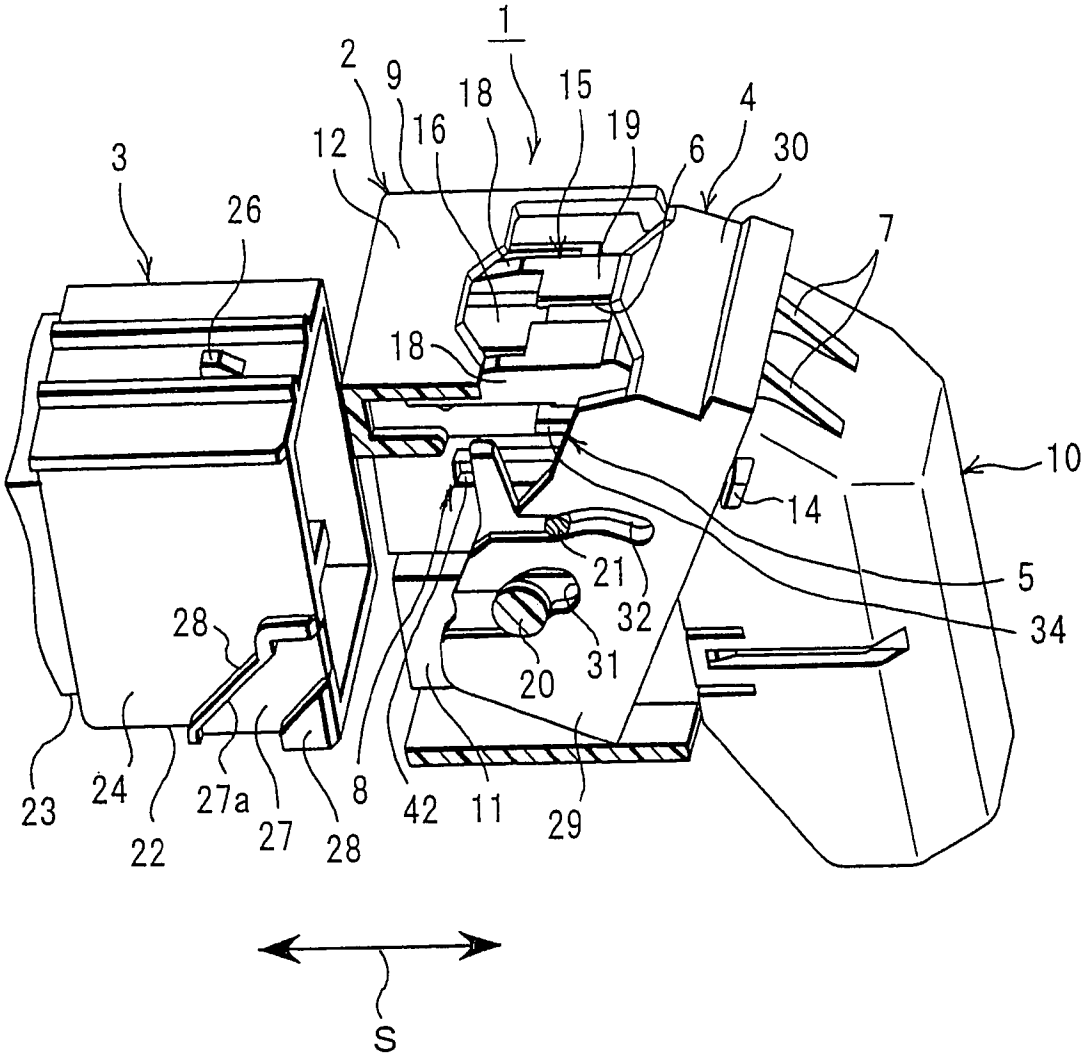
FIG. 2 is a perspective view of the set of connectors shown in FIG. 1, an outer cover of the female connector being partially cross-sectioned.
Figure 18:
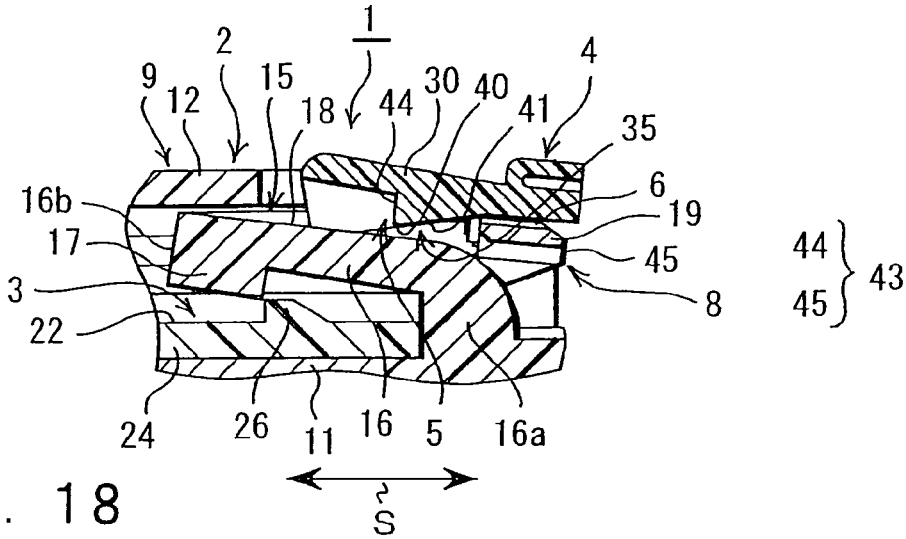
FIG. 18 is a partially expanded cross-sectional view of the second release member releasing an engagement of a lock projection of the lock arm shown in FIG. 17.
Figure 19:
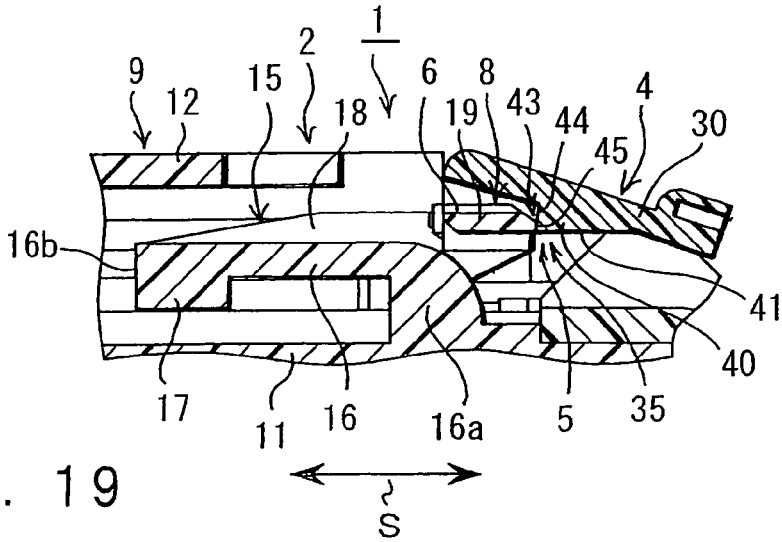
FIG. 19 is a partially expanded cross-sectional view of the lock arm and the second temporary lock of the set of connectors shown in FIG. 3.

A set of connectors 1, as shown in FIGS. 1-16, includes a male connector 2 as the first connector, a female connector 3 as the second connector, a lever 4, an interlocking release member 5 (shown in FIGS. 17-19, 20-21), a pair of guide projections 7 (shown in FIG. 1) and a temporary lock 8 (shown in FIGS. 2, 19).

The male connector 2 includes a connector housing 9 and a cover 10. The connector housing 9 has a box-shape inner housing 11 and a tubular outer cover 12, as shown in FIG. 2. The inner housing 11 is provided with terminal receiving sections 13 (shown in FIG. 3) for receiving a plurality of female terminals (not shown) therein.

The outer cover 12 is formed integrally with the inner housing 11 so as to receive the inner housing 11 inside thereof. An edge of the outer cover 12 at a side apart from the female connector 3 is continued to an outer edge of the inner housing 11.

The cover 10 is formed into a gutter-shape, and mounted at an edge of the inner housing 11 of the connector housing 9 at a side apart from the female connector 3. The cover 10 receives electric wires joined with the female terminals for protecting the electric wires. The cover 10 is also provided with a limit projection 14 projecting therefrom for limiting a later-described operating plate 30 of the lever 4 by interfering with the lever 4 so as not to depart from a later-described first position from the female connector 3.

The inner housing 11 of the male connector 2 is provided at an outer wall thereof (top wall thereof in FIGS. 1, 2) with a lock arm 15. Thus, the lock arm 15 is arranged at the male connector 2.

The lock arm 15 includes an arm main body 16, an engaging projection 17, a pair of operating arms 18, an operating plate 19 and a pair of release projections 36. One end 16*a* of the arm main body 16 is continued to the outer wall of the inner housing 11, that is the male connector 2. The arm main body 16 extends linearly from the one end 16*a* toward the female connector 3. The other end 16*b* of the arm main body 16, close to the female connector 3, is a free end. The engaging projection 17 projects from the other end 16*b* of the arm main body 16 toward the inner housing 11.

A pair of operating arms 18 is formed respectively into a bar-shape. The pair of operating arms 18 is arranged in parallel with a space therebetween. The arm main body 16 is placed between the pair of operating arms 18. The operating arm 18 is continued to the other end 16*b* of the arm main body 16, and extends from the other end 16*b* of the arm main body 16 in a direction to be apart from the female connector 3.

The operating plate 19 connects both other ends of the operating arms 18 at the side apart from the female connector 3. The aforesaid operating plate 19 and the one end 16*a* of the arm main body 16 correspond to the other end of the lock arm 15 described in the claims of the present invention.

The pair of release projections 36 projects from the other end 16*b* of the arm main body 16 of the lock arm 15 toward the inner housing 11. The engaging projection 17 is arranged between the pair of release projections 36.

The aforesaid one end of the lock arm 15 having the arm main body 16 and the operating arm 18 is continued to the male connector 2, and the other end of the lock arm 15 is formed as a free end. When the connectors 2, 3 are coupled, after the engaging projection 17 of the lock arm 15 firstly abuts on a later-described lock projection 26, the arm main body 16 is elastically deformed so as to make the engaging projection 17 ride on the lock projection 26. Thereafter, the engaging projection 17 passes over the lock projection 26, and the arm main body 16 springs back to a neutral position not to be deformed elastically, and the engaging projection 17 is engaged with the lock projection 26. Thus, when the connectors 2, 3 are completely coupled together, the lock arm 15 is engaged with the lock projection 26. By engaging the lock arm 15 and the lock projection 26, the connectors 2, 3 are maintained in a completely coupled condition.

A pivot boss 20 (shown in FIG. 2) and a guide boss 21 (shown in FIG. 2) are provided projectingly from an inner surface of one outer wall of the outer cover 12, which is not overlapped with the lock arm 15. The pivot boss 20 is arranged in a central area of the one outer wall of the aforesaid outer cover 12. The guide boss 21 is located at a side apart more than the pivot boss 20 from the female connector 3 and close to the lock arm 15.

The female connector 3 includes a connector housing 22. The connector housing has a box-shape main body 23 and a tubular portion 24. The main body 23 is provided inside thereof with a terminal receiving section for mainly receiving a wire-connecting portion of a male terminal 25 (shown in FIG. 3). A lock projection 26 is provided on an outer wall of the main body 23. In other words, the female connector 3 is provided with the lock projection 26. The lock projection 26 is formed projectingly from the outer wall of the female connector 3.

The tubular portion 24 of the female connector 3 penetrates between the inner housing 11 and the outer cover 12 of the male connector 2, and the wire-connecting portion of the male terminal 25 penetrates into the terminal receiving section 13 of the inner housing 11 of the male connector 2, and the lock projection 26 is engaged to the engaging projection 17 of the lock arm 15. Thereby, the female connector 3 and the male connector 2 are coupled completely. The female connector 3 and the male connector 2 connect electrically the female terminal and the male terminal 25 so that the wires joined therewith are connected electrically. When the female connector 3 is coupled with the male connector 2, a part of the tubular portion 24 of the connector housing 22 penetrates between a later-described flat plate 29 of the lever 4 and the inner housing 11.

The female connector 3 is further provided with a fitting guide groove 27. The fitting guide groove 27 is formed by a pair of guides 28 arranged with a space between each other. The fitting guide groove 27 is the space between the pair of guides 28. The pair of guides 28 projects from the outer wall of the connector housing 22, that is the female connector 3. The fitting guide groove 27 extends linearly along a direction intersecting a later-described access direction S from an edge, close to the male connector 2, of the tubular portion 24 of the female connector 3 toward an outside of the female connector 3. A width of the fitting guide groove 27 is wider than that of a later-described fitting guide projection 33 of the lever 4.

When the connectors 2, 3 are coupled together, the fitting guide projection 33 penetrates into the fitting guide groove 27. By rotating the lever 4 between a later-described first position and second position, the fitting guide projection 33 moves in the fitting guide groove 27. The fitting guide groove 27 in cooperation with the fitting guide projection 33 moves the connectors 2, 3 in the coupling and uncoupling directions.

When the lever 4 is positioned at the second position, an inner wall 27*a*, at a side apart from the male connector 2, of the fitting guide groove 27 has a space between the fitting guide projection 33 and itself. When the interlocking release member 5 releases the engagement of the lock arm 15 and the lock projection 26 by rotating the lever 4, the fitting guide projection 33 abuts on the aforesaid inner wall 27*a*. When there is the space between the inner wall 27*a* of the fitting guide groove 27 and the fitting guide projection 33, even if the lever 4 is rotated, the connectors 2, 3 are not moved in the coupling and uncoupling directions.

Thus, the fitting guide groove 27 and the fitting guide projection 33 have the space A (shown in FIG. 16) there between. When the lever 4 is rotated from the second position toward the first position, there is the space between the fitting guide projection 33 and the inner wall 27*a* of the fitting guide groove 27 until the interlocking release member 5 releases the engagement of the lock arm 15 and the lock projection. Thereby, if the lever 4 is rotated, the connectors 2, 3 are stopped relatively to each other so that the connectors 2, 3 are maintained in a condition of completely coupled. The space between the inner wall 27*a* of the fitting guide groove 27 and the fitting guide projection 33 corresponds to the fitting hold spacing described in claims of the present invention.

The lever 4 includes the flat plate 29 and the operating plate 30 projecting from an outer edge of the flat plate 29 so as to be formed into an L-shape as a whole when viewing from a side. The flat plate 29 is provided with a pivot oval hole 31 (shown in FIG. 2), a guide oval hole 32 (shown in FIG. 2) and the fitting guide projection 33 (shown in FIG. 4). The pivot oval hole 31 and the guide oval hole pass through the flat plate 29.

The pivot oval hole 31 is provided in a central area of the flat plate 29. The pivot boss 20 penetrates into the pivot oval hole 31. The pivot boss 20 penetrating into the pivot oval hole 31 can freely move in the pivot oval hole 31. The guide oval hole 32 is arranged closer to the operating plate 30 than the pivot oval hole 31. The guide boss 21 penetrates into the guide oval hole 32. The guide boss 21 penetrating into the guide oval hole 32 can freely move in the guide oval hole 32.

The pivot oval hole 31 and the guide oval hole 32 respectively extend in a circular-arc shape. A center of curvatures of the pivot oval hole 31 and the guide oval hole 32 is located at a position closer to the fitting guide projection 33 than the holes 31, 32 and more apart from the female connector than the fitting guide projection 33. The fitting guide projection 33 projects from the flat plate 29 toward the inner housing 11. The fitting guide projection 33 is located at a position more apart from the operating plate 30 than the pivot oval hole 31.

The pivot boss 20 penetrates into the pivot oval hole 31 and the guide boss 21 penetrates into the guide oval hole 32, thereby the flat plate 29 is located between the inner housing 11 and the aforesaid one outer wall of the outer cover 12. The pivot boss 20 moves in the pivot oval hole and the guide boss 21 moves in the guide oval hole 32. Thereby, the flat plate 29 is mounted on the connector housing 9, that is male connector 2, rotatably about one end thereof apart from the operating plate 30.

The flat plate 29 is located between the inner housing 11 and the outer cover 12, and rotates, thereby, the operating plate 30 is positioned at a position where the operating plate can be overlapped on the lock arm 15.

The aforesaid lever 4 is mounted on the male connector 2 so as to make the bosses 20, 21 penetrate into the oval holes 31, 32 and to have a gap by the inner housing 11. The lever 4 is supported rotatably about the one end thereof by the male connector 2. Furthermore, the fitting guide projection 33 provided at the lever 4 penetrates into the fitting guide groove 27 of the female connector 3. By rotating the lever 4 about the aforesaid one end, the fitting guide projection 33 slides (moves) in the fitting guide groove 27, thereby, the female connector 3 and male connector 2 are moved in the coupling and uncoupling directions.

The lever 4 is mounted rotatably against the male connector 2 between the first position (shown in FIG. 2) where the lock arm 15 and the lock projection 26 can be separated completely, and the connectors 2, 3 are separated completely and the second position (shown in FIG. 14) where the lock arm 15 is engaged completely with the lock projection 26, and the connectors 2, 3 are coupled completely. At the second position, the lever 4 is received between the outer cover 12 and the inner housing 11 and the operating plate 30 overlaps over the lock arm 15. At the first position, the operating plate 30 of the lever 4 is exposed from a space between the outer cover 12 and the inner housing 11.

Figure 15:
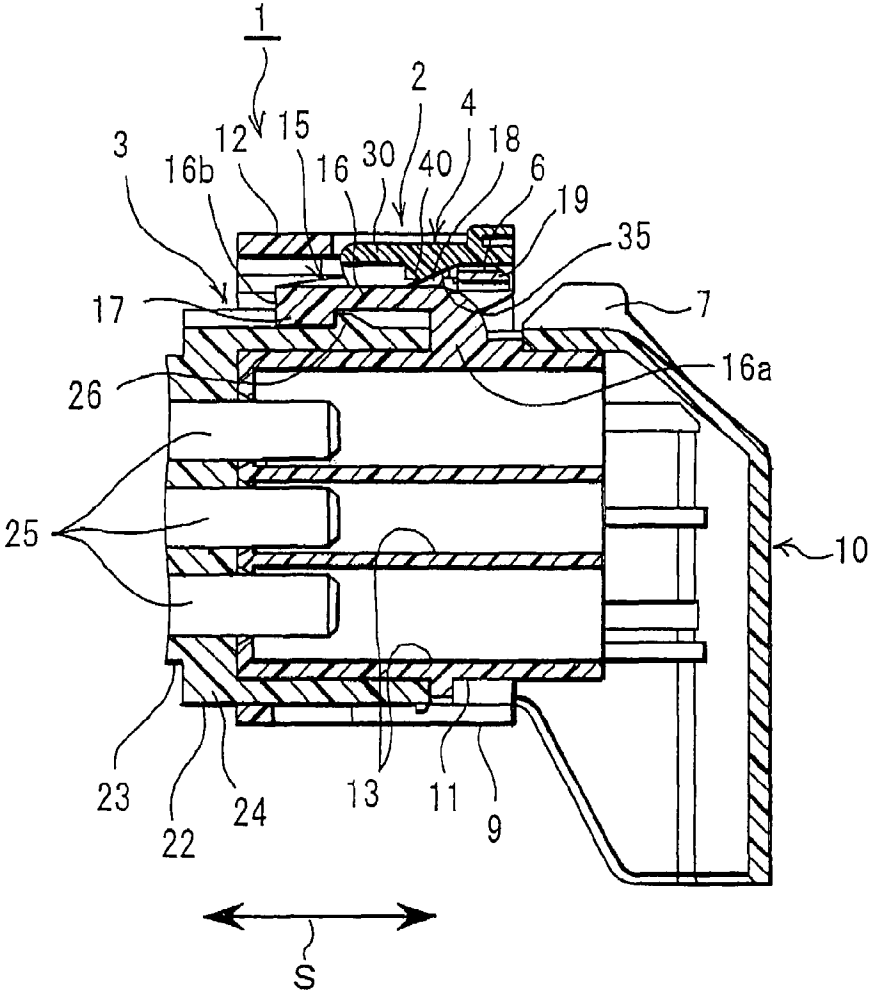
FIG. 15 is a cross-sectional view of the set of connectors shown in FIG. 13 at a position where the lock arm of the female connector can be seen.

The interlocking release member 5 includes a first release member 34 (shown in FIG. 2) and a second release member 35 (shown in FIG. 15). The first release member 3 has a pair of release arms 37 as shown in FIGS. 20, 21.

The pair of release arms 37 is arranged with a distance between each other, and positions the arm body 16 of the lock arm 15 therebetween. The release arm has a bar-shape arm main body 38 extending from the operating plate 30 of the lever 4 toward the female connector 3, and an interference member 39 projecting from an end, close to the female connector 3, of the arm main body 38 in a direction that the pair of release arms 37 approaches each other. Thus, the arm main body 16 is continued to the operating plate 30 of the lever 4 so that the release arm 37, that is the first release member 34, is arranged at the lever 4.

The interference member 39 is positioned between the arm main body 16 of the lock arm 15 and the inner housing 11. The interference member 39 is aligned together with the release projection 36 along the access direction S (shown with an arrow in FIG. 1) of the connectors 2, 3. The access direction S means a direction, in which connectors 2, 3 move relatively in the coupling and uncoupling directions.

When the lever 4 is positioned at the aforesaid second position, the interference member 39 is positioned closer to the female connector 3 than the release projection 36. When the lever 4 is positioned at the aforesaid first position, the interference member 39 is positioned apart from the female connector 3 than the release projection 36. When the lever 4 rotates between the first position and the second position, the interference member 39 abuts on the release projection 36 and deforms elastically the arm main body 16 of the lock arm 15 so as to make the engaging projection 17 move apart from the lock projection 26 for riding the release projection 36 over the interference member 39. When the lever 4 starts to rotate from the second position toward the first position, the release projection 36 rides on the interference member 39.

According to the first release member 34 as structured above, when the lever 4 is positioned at the second position, in other words, the connectors 2, 3 are coupled together completely, and the lever 4 is rotated toward the first position, the interference member 39 penetrates between the release projection 36, that is the other end 16*b* of the lock arm 15 and the inner housing 11, that is male connector 2 so as to deform elastically the arm main body 16 of the lock arm 15 to release the engagement of the engaging projection 17 and the lock projection 26.

The second release member 35 has a pushing portion 40 projecting from the operating plate 30 of the lever 4 toward the male connector 2. A tapered surface 41 is provided at a side, apart from the female connector 3, of the pushing portion 40. When the lever 4 is positioned at the second position, the tapered surface 41 slants about the access direction S gradually toward the outside of the male connector 2 in accordance with departing from the female connector 3.

When the lever 4 is positioned at the second position, the pushing portion 40 of the second release member 35 is located closer to the female connector 3 than the operating plate 19 of the lock arm 15. When the lever 4 is positioned at the first position, the pushing portion 40 of the second release member 35 is located more apart from the female connector 3 than the operating plate 19 of the lock arm 15. When the lever 4 rotates from the second position toward the first position, the pushing portion 40 abuts on the operating plate 19 of the lock arm 15 and pushes the one end of the lock arm 15 by the tapered surface 41 toward the inner housing 11, that is the male connector 2.

The pushing portion 40 deforms the arm main body 16 of the lock arm 15 to make the engaging projection 17 move apart from the lock projection 26. When the lever 4 starts to rotate from the second position toward the first position and the release projection 36 rides on the interference member 39 of the release arm 37, the pushing portion 40 pushes the operating plate 19 of the lock arm 15.

When the lever 4 rotates toward the first position from the second position in which the connectors 2, 3 are completely coupled, the pushing portion 40 pushes the operating plate, that is one end, of the lock arm 15 toward the inner housing, that is the male connector 2 to deform elastically the arm main body 16 of the lock arm 15 for releasing the engagement of the engaging projection 17 and the lock projection 26.

The guide groove 6 is formed to recess the operating plate 19 of the lock arm 15. In other words, the guide groove 6 is provided at the lock arm 15. The guide groove 6 extends linearly along the access direction S. The pushing portion 40 of the second release member 35 penetrates into the guide groove 6. When the lever 4 rotates, the pushing portion 40 penetrates into the guide groove 6 to guide the pushing portion 40 to move along the access direction S.

The pair of guide projections 7 is arranged with a space along a direction perpendicular to the access direction S. The pair of guide projections 7 is formed on an outer surface of the cover 10 of the male connector 2 projectingly from a position close to the lock arm 15. The pair of guide projections 7 is a wall extending linearly along the access direction S. When the lever 4 rotates, the pair of guide projections 7 passes the pushing portion 40 of the second release member 35 therebetween. When the lever 4 rotates, the pushing portion 40 penetrates between the pair of guide projections 7 so as to guide the pushing portion 40 of the second release member 35 to move along the access direction S.

Figure 3:
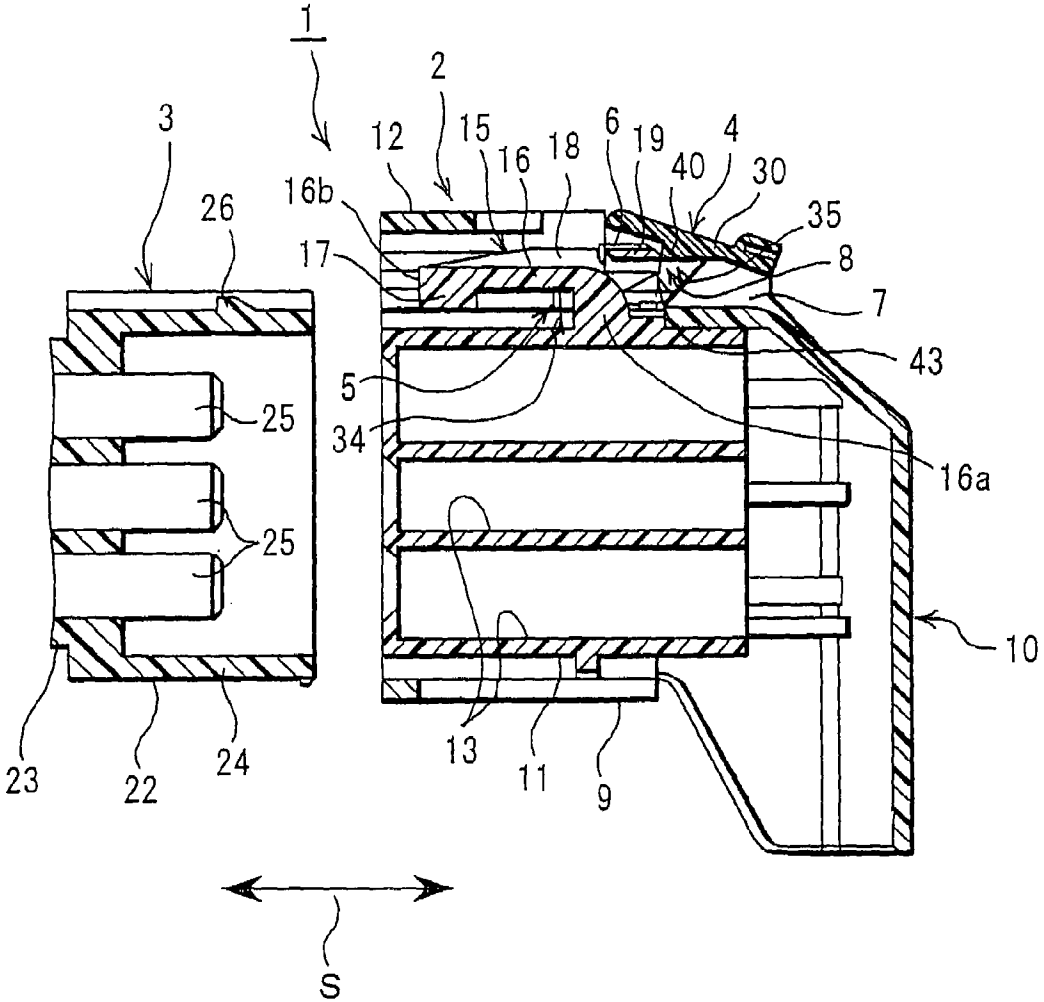
FIG. 3 is a cross-sectional view of the set of connectors shown in FIG. 1 at a position where a lock arm of the female connector can be seen.
Figure 4:
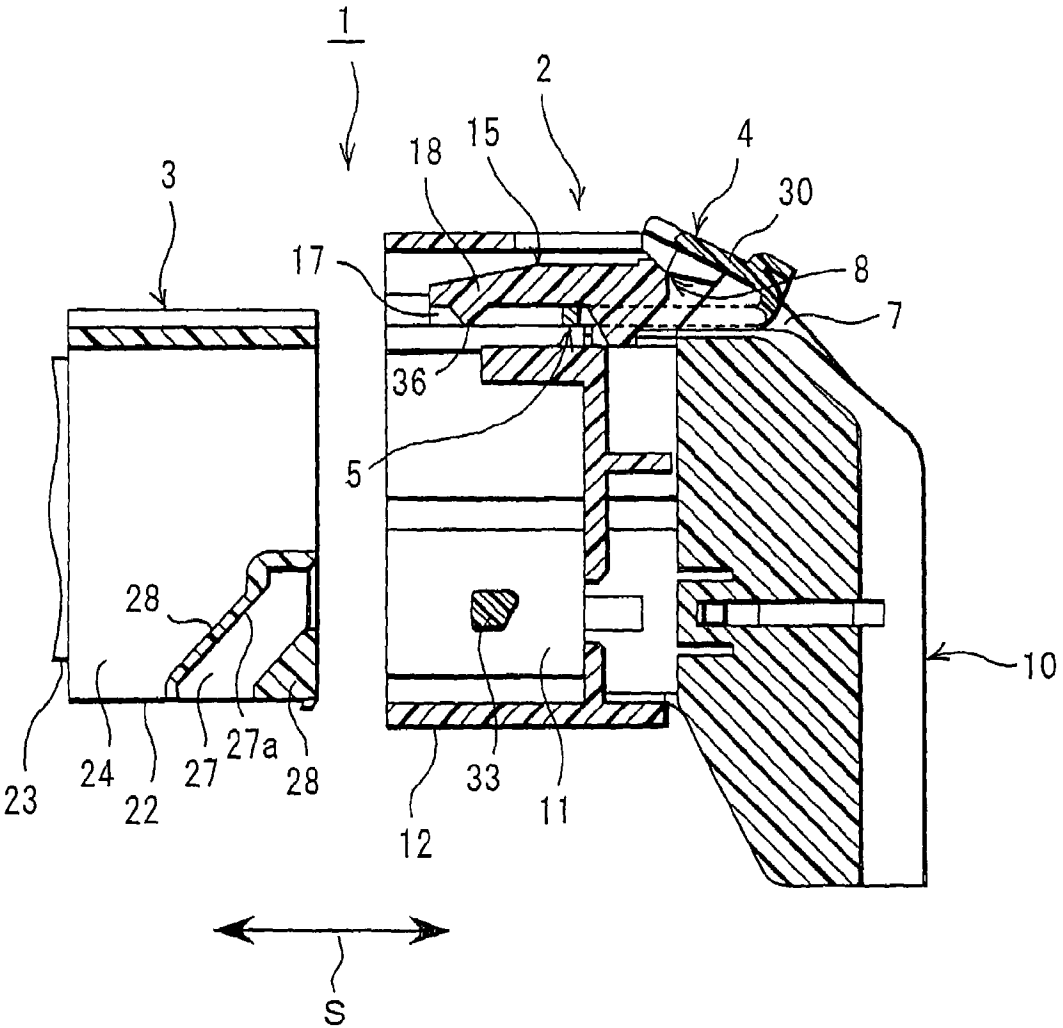
FIG. 4 is a cross-sectional view of the set of connectors shown in FIG. 1 at a position where a release arm of a lever of the female connector can be seen.

The temporary lock 8 includes a first temporary lock 42 (shown in FIG. 2) and a second temporary lock 43 (shown in FIG. 3). The first temporary lock 42 is formed projectingly from the outer wall of the inner housing of the male connector 2 to be retractable from the outer wall. When the first temporary lock 42 projects from the outer wall of the inner housing 11, the first temporary lock 42 interferes with an outer edge of the lever 4 to hold the lever 4 at the first position.

When the connectors 2, 3 are fitted together, the first temporary lock 42 is pushed to retract into an inside of the inner housing 11 by the tubular portion 24 of the female connector 3 so as not to interfere with the outer edge of the lever 4. Thereby, the first temporary lock 42 releases a lock of the lever 4 which interlocks when the connectors 2, 3 are approaching in the coupling direction.

The second temporary lock 43 has a vertical surface 44 provided at the pushing portion 40 and a vertical surface 45 provided at the operating plate 19 of the lock arm 15, as shown in FIG. 19. When the lever 4 is positioned at the second position, the vertical surfaces 44, 45 are formed in parallel to a direction perpendicular to the coupling and uncoupling direction S. The vertical surface 44 is provided at a position, close to the female connector 3, of the pushing portion 40. The vertical surface 45 is provided at a position, most apart from the female connector 3, of the operating plate 19. When the lever 4 is positioned at the first position, the second temporary lock 43 holds the lever 4 on the male connector 2 by abutting the vertical surfaces 44, 45 to each other.

When the engaging projection 17 rides on the lock projection 26 for fitting the connectors together, the vertical surfaces 44, 45 depart from each other. The second engaging member 43 releases holding of the lever 4 with the interlocking to couple the connectors 2, 3 to each other.

For coupling the male connector 2 and the female connector 3 of the set of connectors 1 to each other, by receiving the female terminals with electric wires in the connector housing 9, mounting the cover 10 and the lever 4 on the connector housing 9, the male connector 2 is assembled. By receiving the male terminals 25 with an electric wire in the connector housing 22, the female connector 3 is assembled.

Figure 5:
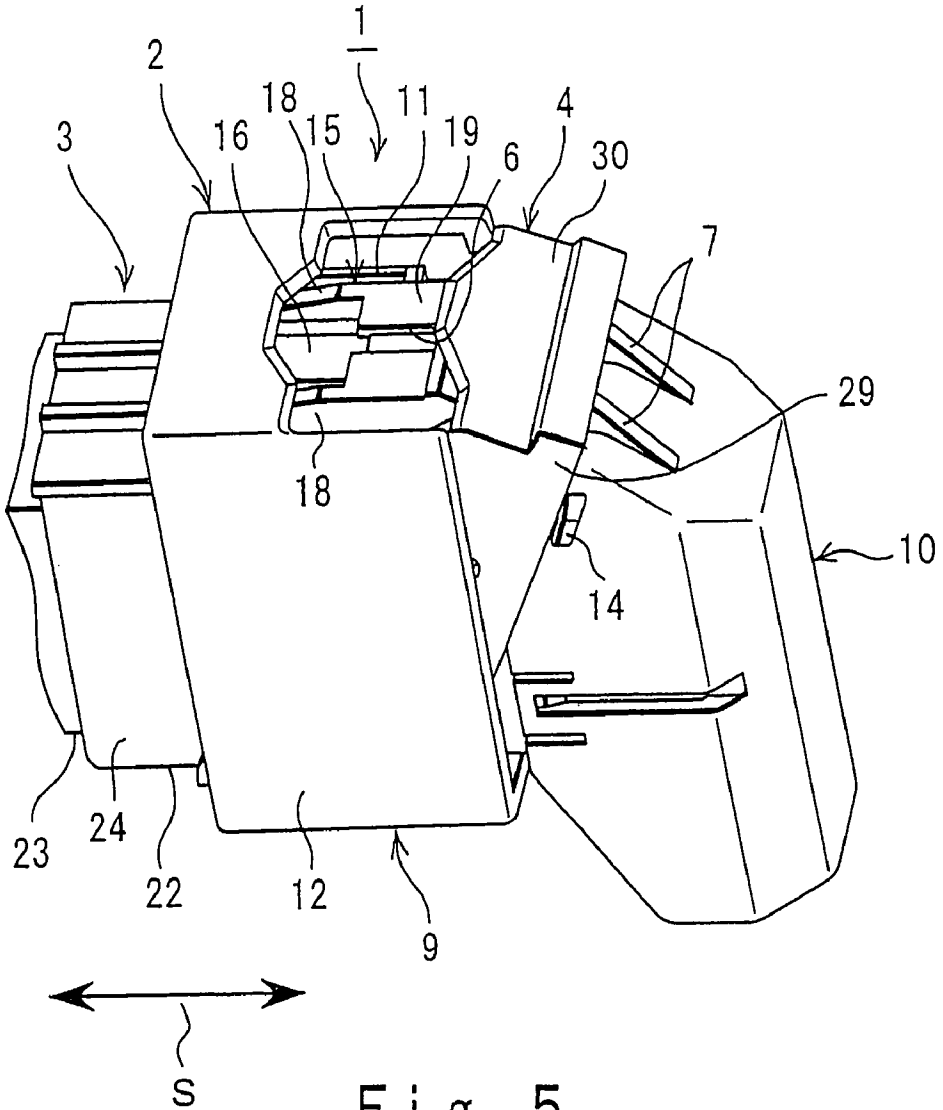
FIG. 5 is a perspective view of the female connector and the male connector of the set of connectors shown in FIG. 1 starting to be coupled
Figure 6:
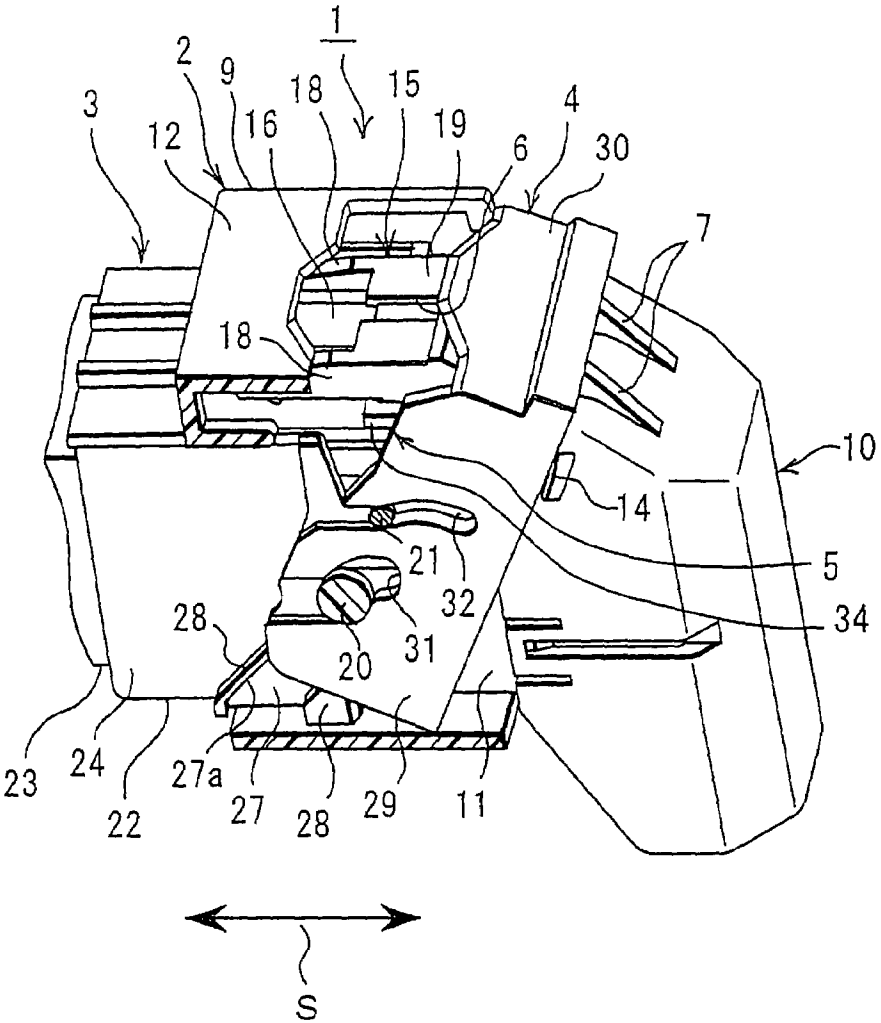
FIG. 6 is a perspective view of the set of connectors shown in FIG. 5, the outer cover of the female connector being partially cross-sectioned.

Thereby, the lever 4 is held (positioned) at the first position as shown in FIGS. 1, 2 by the limit projection 14 and the temporary lock 8. At that time, the pushing portion 40 is positioned between the pair of guide projections 7, and the vertical surfaces 44, 45 of the second temporary lock 43 overlap on each other as shown in FIG. 19. The male connector 2 and the tubular portion 24 of the female connector 3 are opposed to each other as shown in FIGS. 1-4. Thereafter, the connectors 2, 3 are made to move in the coupling direction, and the tubular portion 24 of the female connector 3 is inserted gradually into the outer cover 12 of the male connector 2 as shown in FIGS. 5, 6, and the inner housing 11 of the male connector 2 is inserted gradually into the tubular portion 24 of the female connector 3.

Figure 7:
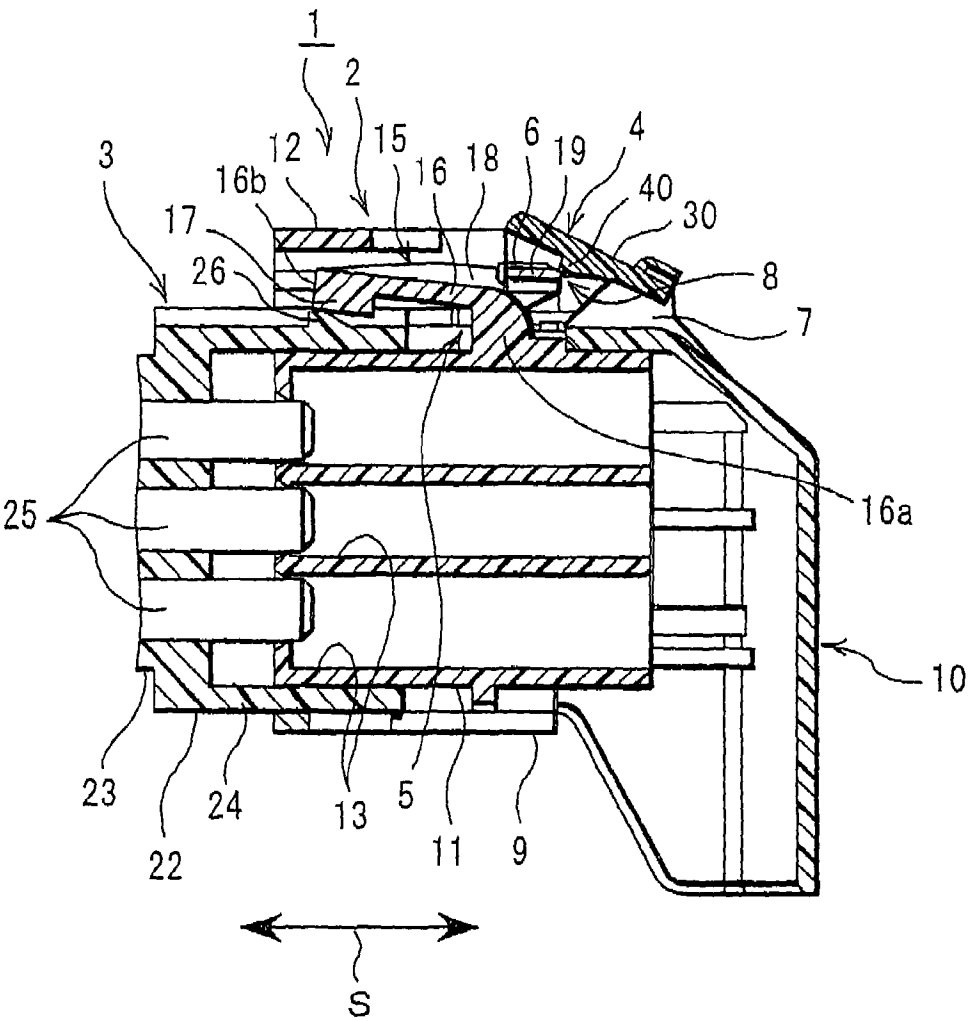
FIG. 7 is a cross-sectional view of the set of connectors shown in FIG. 5 at a position where the lock arm of the female connector can be seen.
Figure 8:
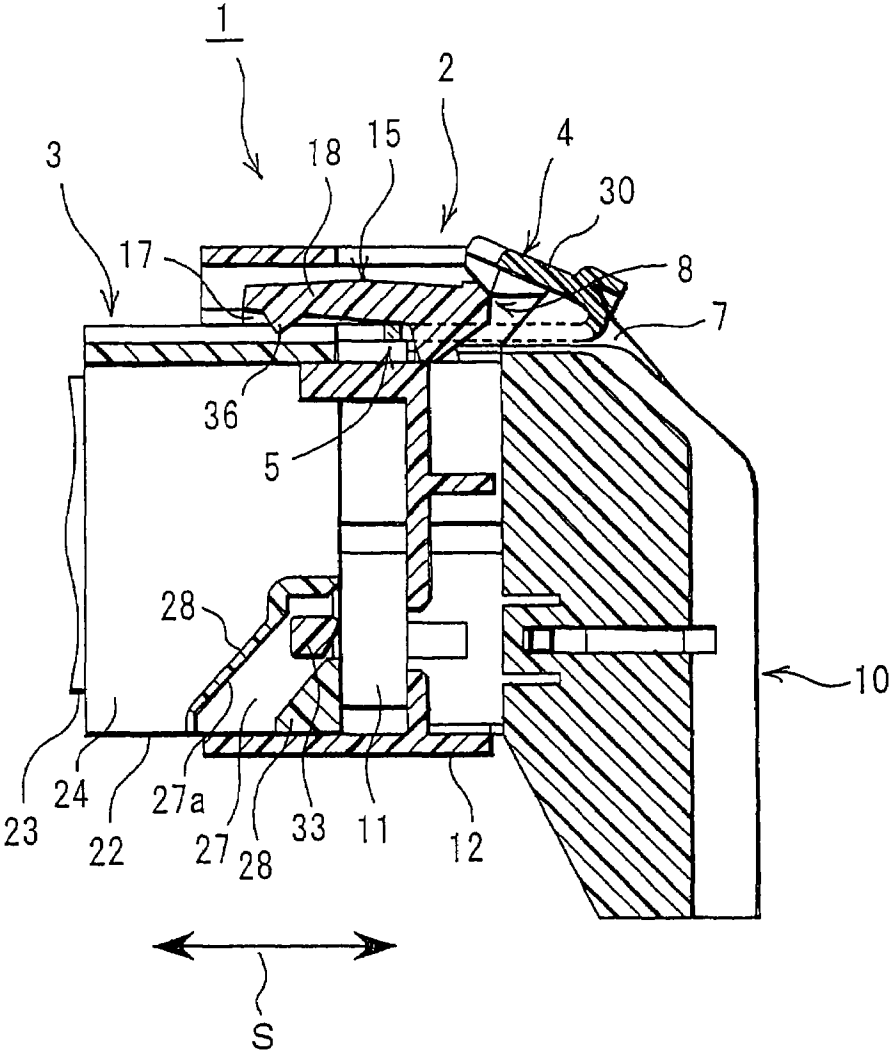
FIG. 8 is a cross-sectional view of the set of connectors shown in FIG. 5 at a position where the release arm of the lever of the female connector can be seen.

Thereby, the engaging projection 17 of the lock arm 15 rides on the lock projection 26, and the wire-connecting portion of the male terminal 25 penetrates gradually into the terminal receiving section 13 of the male connector 2 as shown in FIG. 7. The lock arm 15 is elastically deformed so as to make the other end 16*b* apart from the inner housing 11 as shown in FIGS. 7, 8. Furthermore, the fitting guide projection 33 penetrates into the fitting guide groove 27 as shown in FIG. 8.

When the inner housing 11 penetrates into the tubular portion 24 of the female connector 3, the lock of the lever 4 by the first temporary lock 42 of the temporary lock 8 is released. Furthermore, the operating plate 19 of the lock arm 15 approaches the inner housing 11, and the vertical surfaces 44, 45 are separated from each other. Thereby, the lock of the lever 4 by the second temporary lock 43 of the temporary lock 8 is released. Thus, the lever 4 is allowed to rotate toward the second position.

When the lever 4 rotates toward the second position, since the oval holes 31, 32 are formed into a circular arc shape, the fitting guide projection 33 moves toward a far side of the fitting guide groove 27 and apart from the female connector 3 in accordance with the rotation of the lever 4. Thereby, the fitting guide projection 33 moves slidingly in the fitting guide groove 27 and the connectors 2, 3 approaches each other in accordance with the rotation of the lever 4 from the first position toward the second position.

Figure 9:
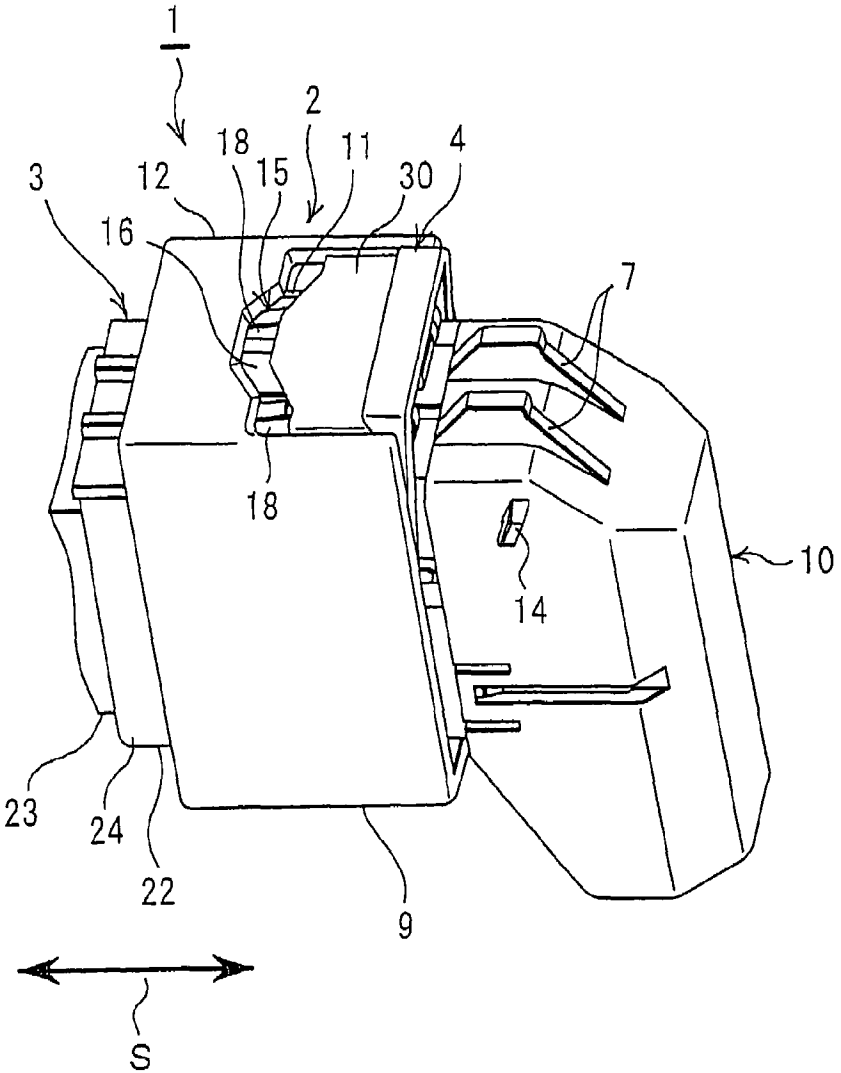
FIG. 9 is a perspective view of the female connector and the male connector of the set of connectors shown in FIG. 1 just before complete coupling.
Figure 10:
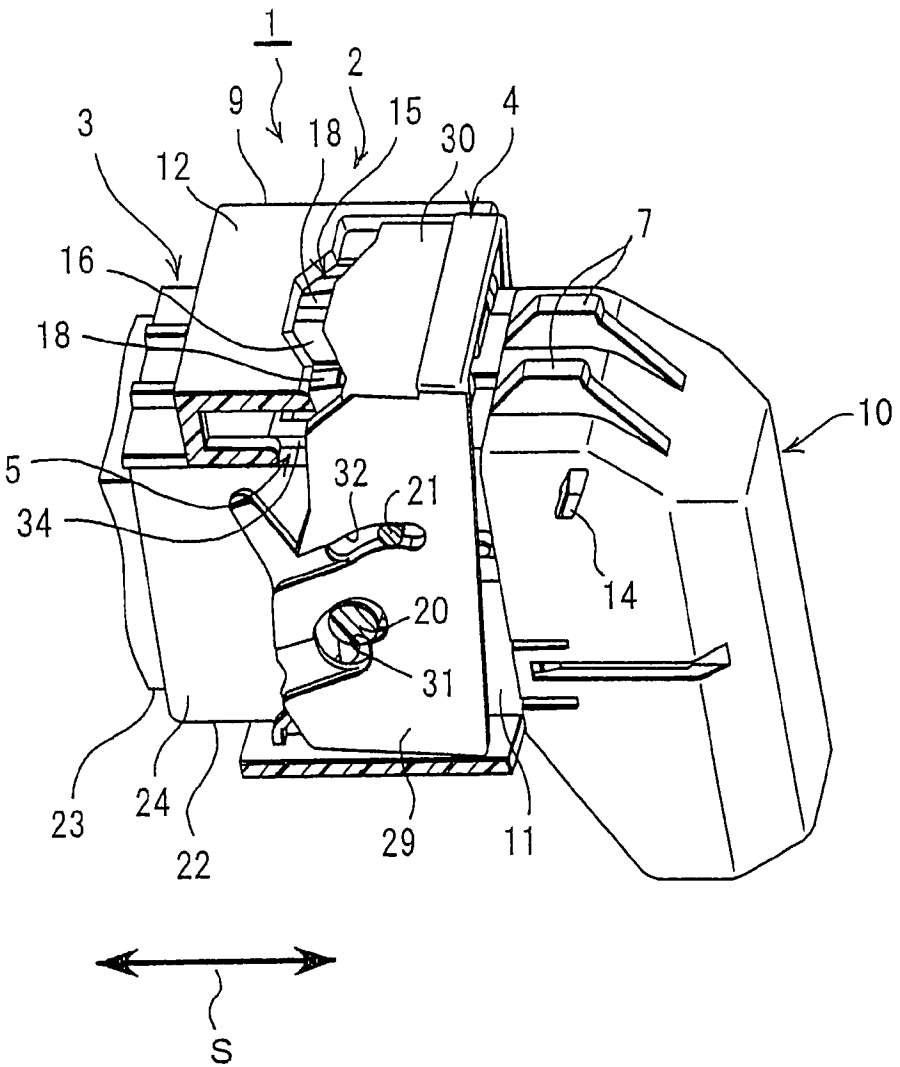
FIG. 10 is a perspective view of the set of connectors shown in FIG. 9, the outer cover of the female connector being partially cross-sectioned.
Figure 11:
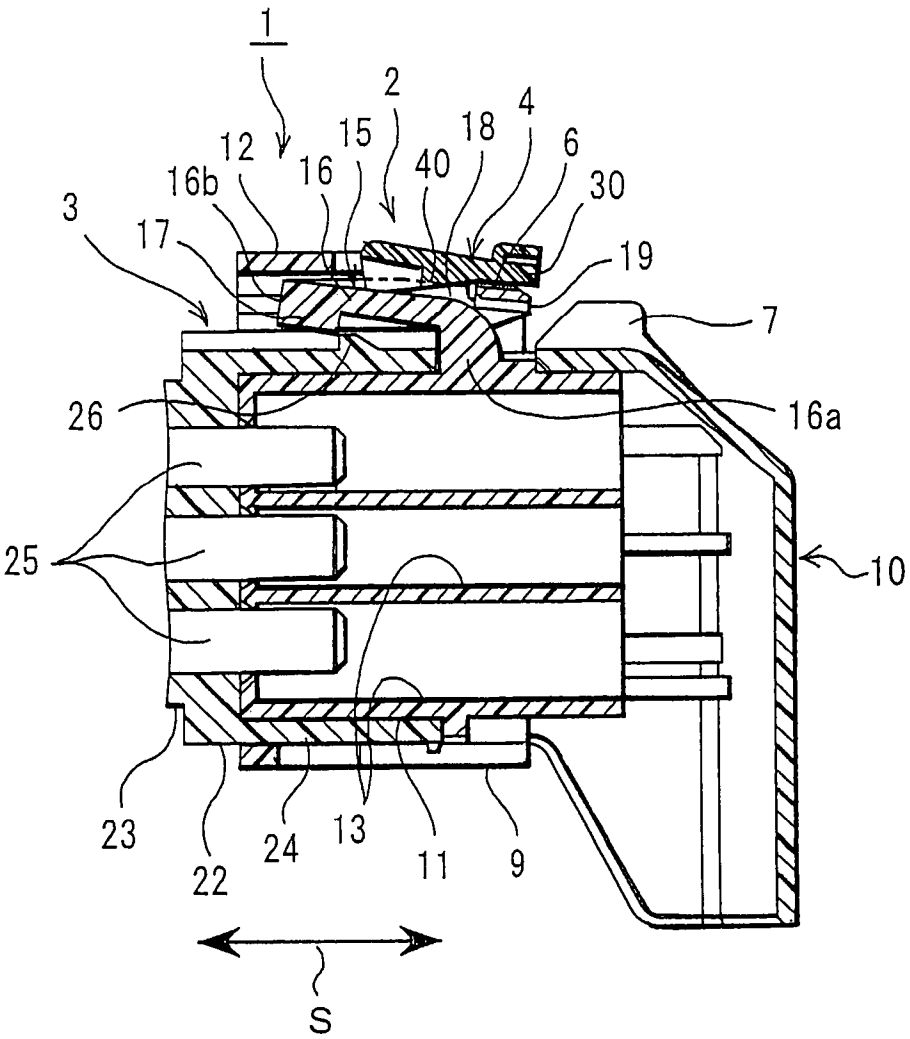
FIG. 11 is a cross-sectional view of the set of connectors shown in FIG. 9 at a position where the lock arm of the female connector can be seen.
Figure 12:
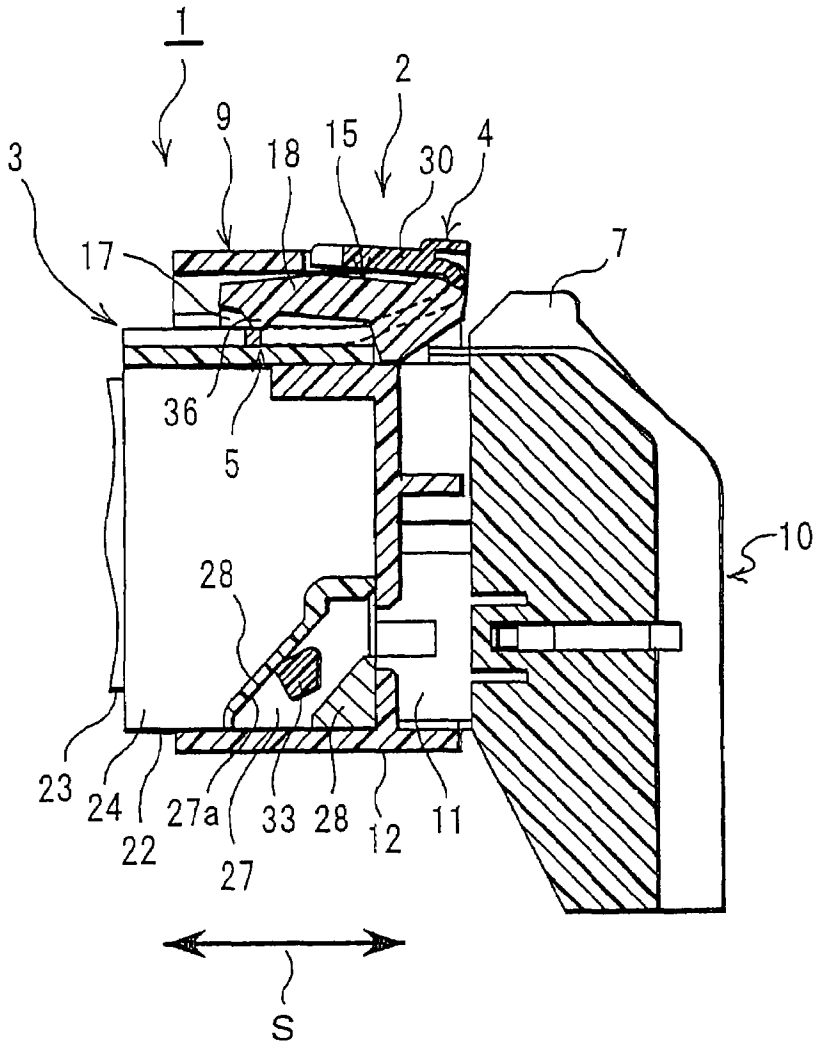
FIG. 12 is a cross-sectional view of the set of connectors shown in FIG. 9 at a position where the release arm of the lever of the female connector can be seen.

Thereafter, the pushing portion 40 penetrates from a space between the pair of guide projections 7 into the guide groove 6, as shown in FIGS. 9, 10. Thereby, the pushing portion 40 passes over the operating plate 19 of the lock arm 15 so as to be positioned closer to the female connector 3 than the operating plate 19, as shown in FIG. 11. Then, the release projection 36 rides on the interference member 39 as shown in FIG. 12.

Figure 13:
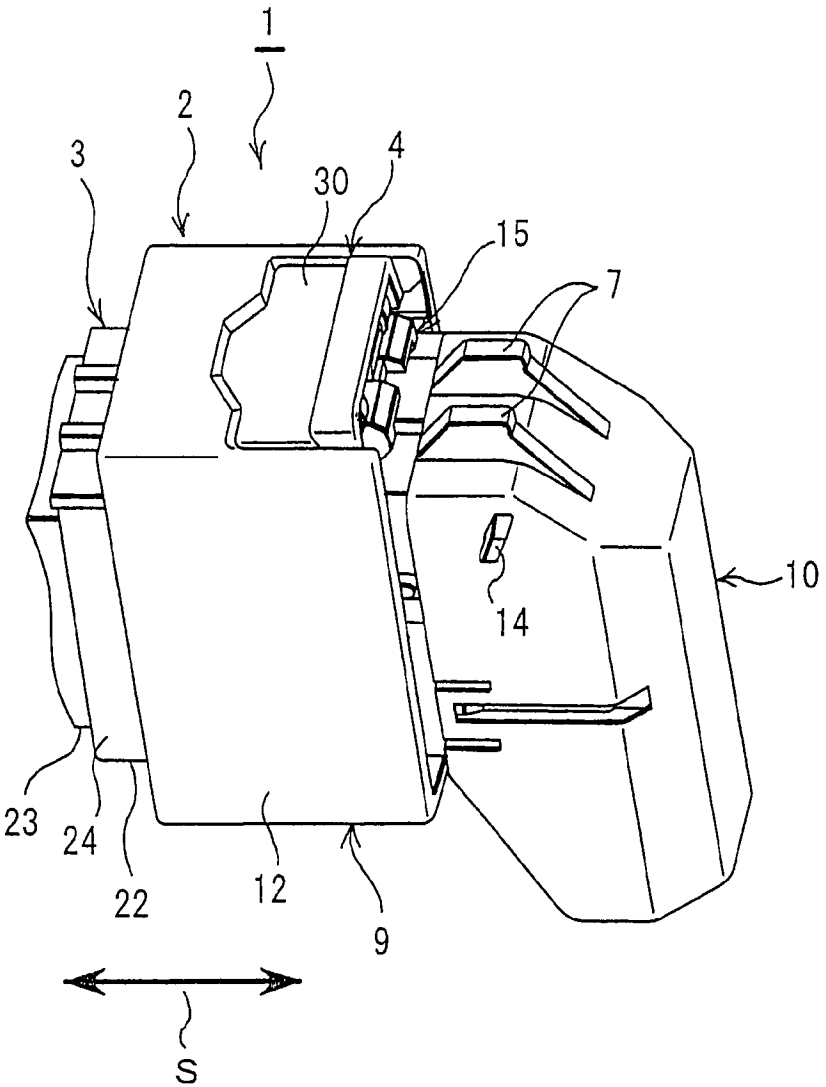
FIG. 13 is a perspective view of the female connector and the male connector of the set of connectors shown in FIG. 1 being completely coupled.
Figure 14:
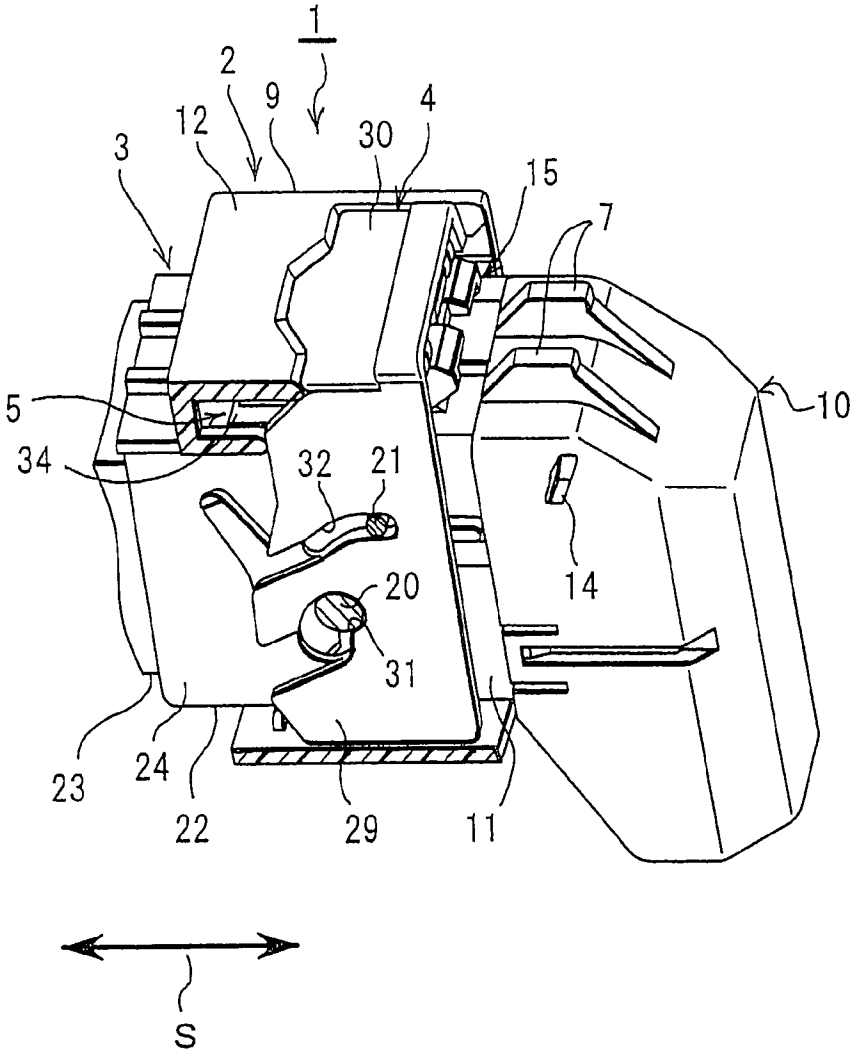
FIG. 14 is a perspective view of the set of connectors shown in FIG. 13, the outer cover of the female connector being partially cross-sectioned.
Figure 16:
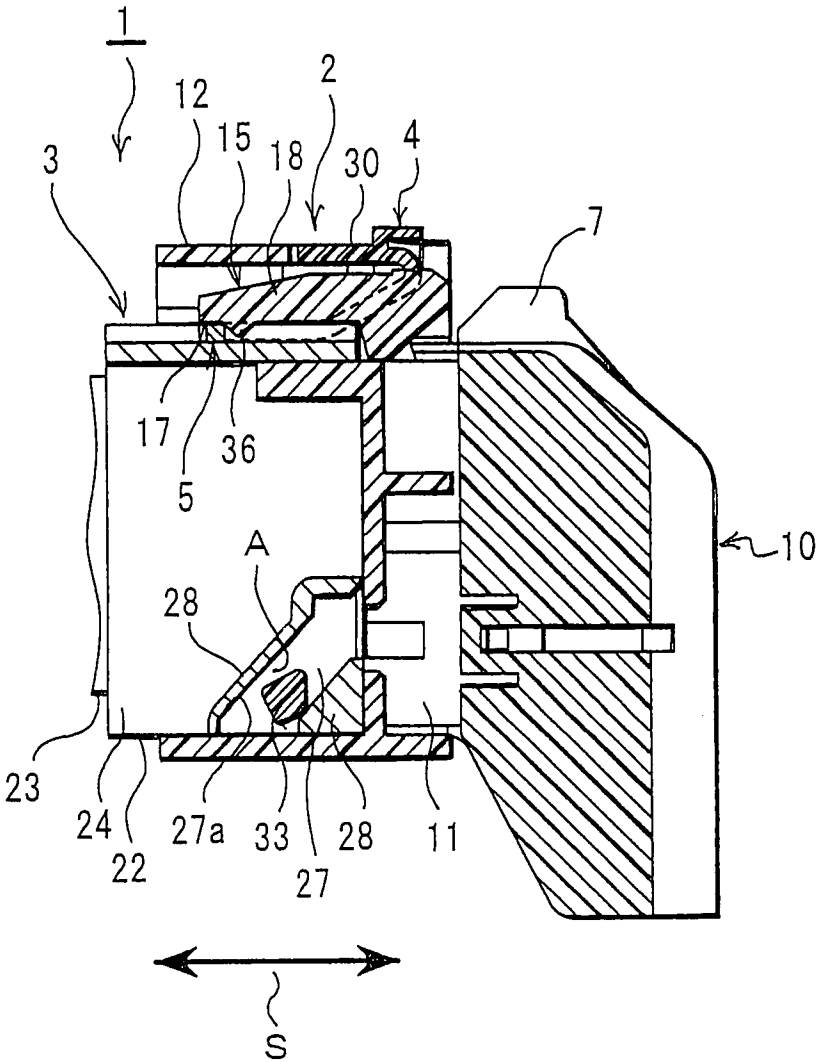
FIG. 16 is a cross-sectional view of the set of connectors shown in FIG. 13 at a position where the release arm of the lever the female connector can be seen.

Thereafter, the lever 4 further rotates toward the second position, so that the engaging projection 17 passes over the lock projection 26 so as to be positioned closer to the female connector 3 than the lock projection 26, as shown in FIG. 15. Then, the interference member 39 is positioned closer to the female connector 3 than the release projection 36, as shown in FIG. 16. Thereby, the lock arm 15 springs back to the neutral position without elastic deformation, and the engaging projection 17 is engaged with the lock projection 26. Then, the connectors 2, 3 are fitted completely, and the lever 4 is positioned at the second position as shown in FIGS. 13, 14. The lever 4 keeps the fitting guide projection 33 placed in the fitting guide groove 27 maintained at the second position, so that the connectors 2, 3 are maintained in complete coupled condition. At this time, the fitting guide projection 33 has the space against the inner wall 27*a* of the coupled guide groove 27.

Figure 17:
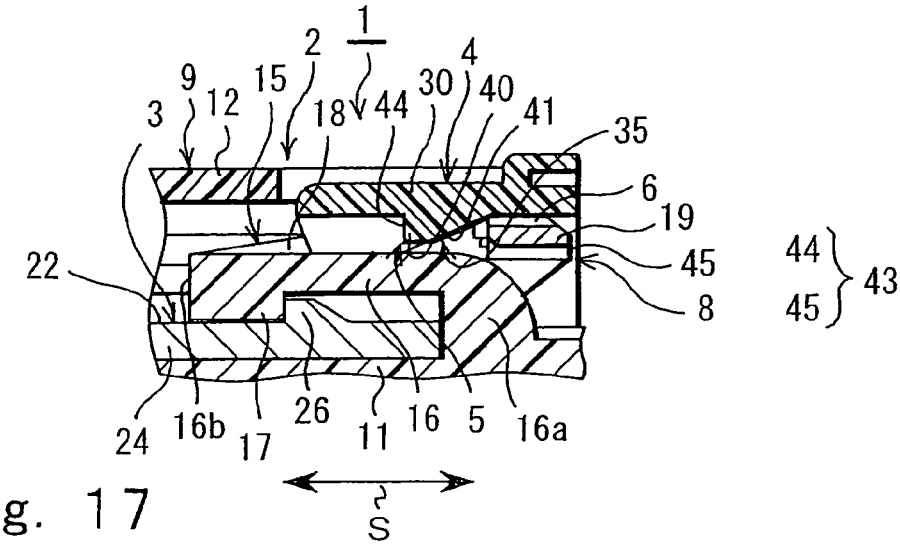
FIG. 17 is a partially expanded cross-sectional view of the lock arm and a second release member of the set of connectors shown in FIG. 15.
Figure 20A:
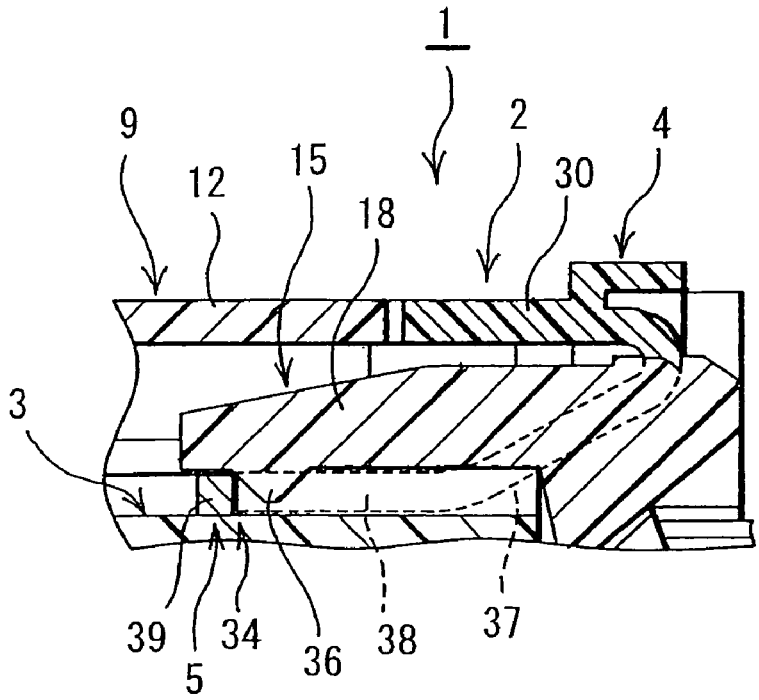
FIG. 20A is a partially expanded cross-sectional view of the lock arm and a first release member of the set of connectors shown in FIG. 16.
Figure 20B:
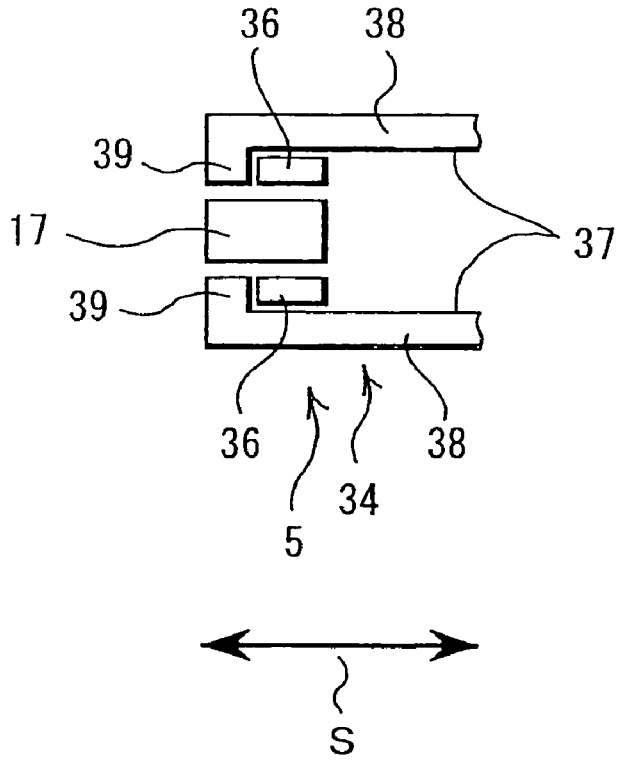
FIG. 20B is a plan view illustrating a positional relationship of an interference member of the first release member and a release projection shown in FIG. 20A.

When the connectors 2, 3 are completely coupled, the pushing portion 40 provided at the operating plate 30 of the lever 4 is located closer to the female connector 3 than the operating plate 19 of the lock arm 15, as shown in FIG. 17. Furthermore, the engaging projection 17 is located closer to the female connector 3 than the lock projection 26, and the interference member 39 of the release arm 37 is located closer to the female connector 3 than the release projection 36 as shown in FIGS. 20A, 20B. The lock arm 15 is held in the neutral position without elastic deformation.

Figure 21A:
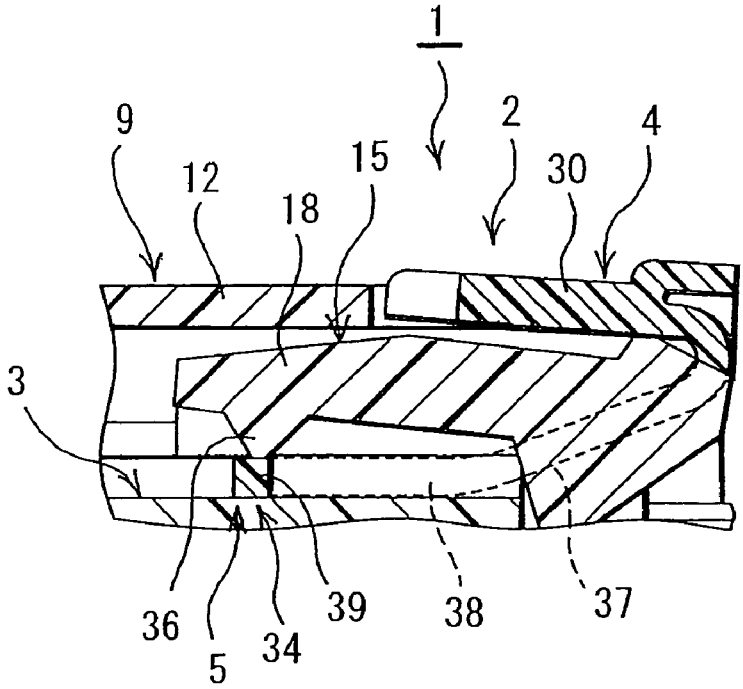
FIG. 21A is a partially expanded cross-sectional view of the first release member releasing the engagement of the lock arm and the lock projection shown in FIG. 20A.
Figure 21B:
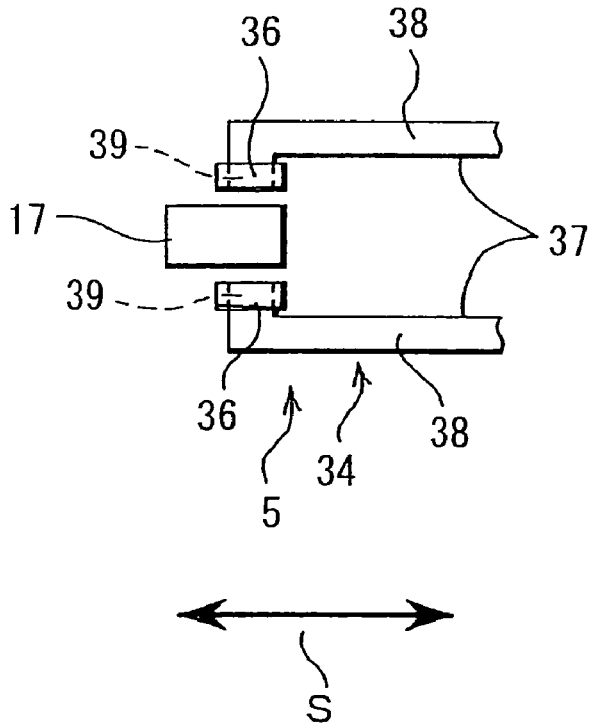
FIG. 21B is a plan view illustrating a positional relationship of the interference member of the first release member and the release projection shown in FIG. 21A.
Figure 22:
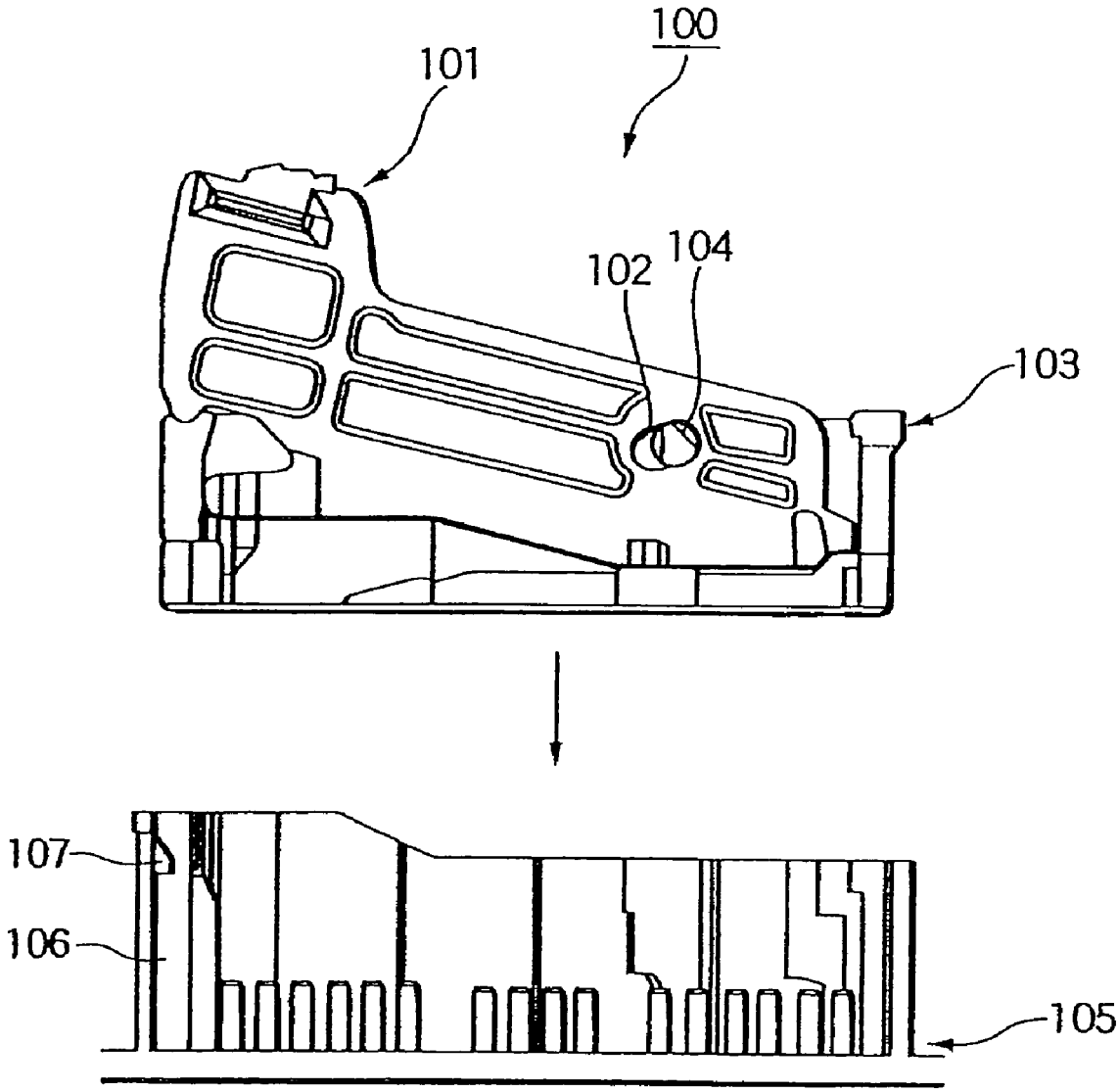
PRIOR ART Fig. 22
FIG. 22 is a cross-sectional view of a female connector and a male connector before coupling of lever-type connectors of the prior art.
Figure 23:
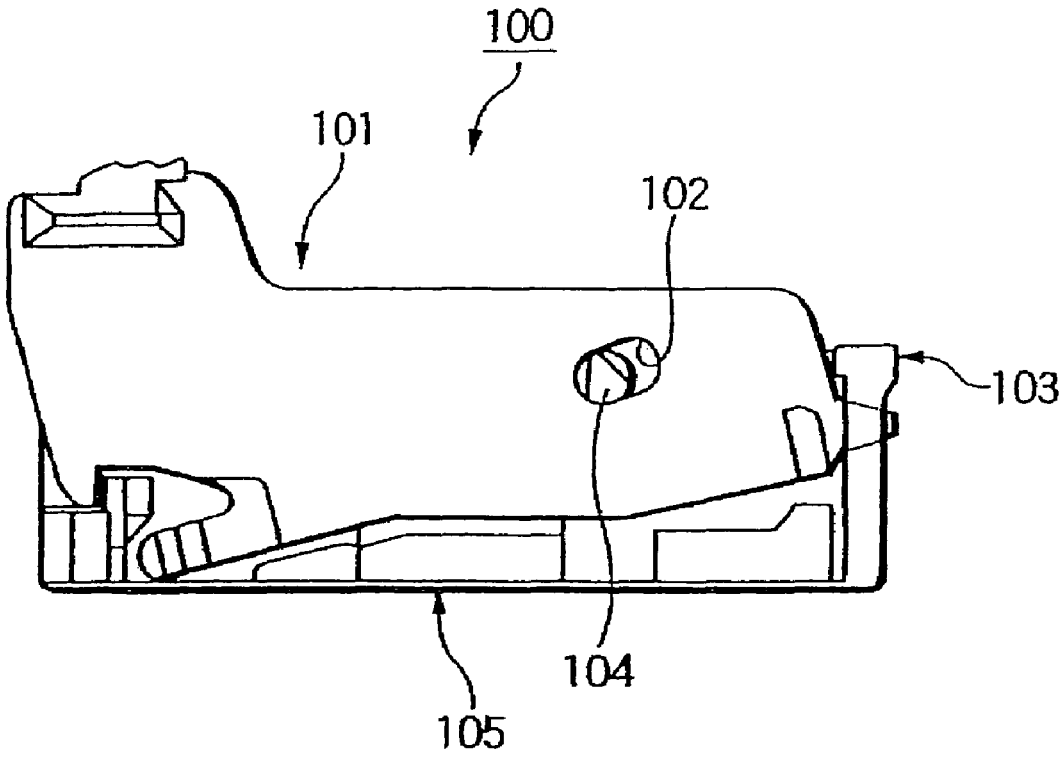
PRIOR ART Fig. 23
FIG. 23 is a cross-sectional view of the female connector and the male connector of the lever-type connectors shown in FIG. 22 being completely coupled.

When the connectors 2, 3 coupled together are separated from each other, the lever 4 positioned at the second position is rotated toward the first position. The fitting guide projection 33 approaches the inner wall 27*a* of the fitting guide groove 27 in accordance with the rotation of the lever 4. Furthermore, the release projection 36 rides on the interference member 39 of the release arm 37, and the pushing portion 40 pushes the operating plate 19 toward the inner housing 11, as shown in FIGS. 21A, 21B.

Thereby, the lock arm 15 is elastically deformed so as to make the other end 16*b* move away from the inner housing 11, and the engagement of the engaging projection 17, that is the lock arm 15 and the lock projection 26 is released, as shown in FIG. 18. When the engagement of the engaging projection 17, that is the lock arm 15 and the lock projection 26 is released, the fitting guide projection 33 abuts on the inner wall 27*a* of the fitting guide groove 27. In accordance with the further rotation of the lever 4 toward the first position, the fitting guide projection 33 moves slidingly on the inner wall 27*a*, and the connectors 2, 3 are separated gradually. Thus, when the lever 4 is rotated from the second position toward the first position, the interlocking release member 5 releases the engagement of the lock arm 15 and the lock projection 26 with the rotation of the lever 4 to release the coupling of the connectors 2, 3. When the first release member 34 and the second release member 35 of the interlocking release member 5 are releasing the engagement of the lock arm 15 and the lock projection 26, the connectors 2, 3 are not moved relative to each other (stopped and not apart from each other owing to the space A between the fitting guide projection 33 and the inner wall 27*a* of the fitting guide groove 27).

According to the embodiment, the lever 4 maintains coupling of the male connector 2 and the female connector 3, and the lock arm 15 and the lock projection 26 are engaged to each other for maintaining coupling of the male connector 2 and the female connector 3. Without the lever 4, the coupling of the male connector 2 and the female connector 3 can be maintained.

Thereby, after coupling the connectors 2, 3 by the lever 4, the lever 4 can be removed. If the lever 4 is broken, the coupling of the connectors 2, 3 can be maintained. Therefore, the mechanical strength of the lever 4 can be reduced from that of the usual one by forming in an L-shape, so that the lever 4 can be miniaturized and the set of connectors 1 also can be miniaturized. The set of connectors can be arranged so as to remove the lever 4. The space for arranging the set of connectors can be reduced, and the set of connectors can be arranged in a narrow space.

The interlocking release member 5 releases the engagement of the lock arm 15 and the lock projection 26 with the rotation of the lever 4 for releasing the coupling of the connectors 2, 3. Thereby, the set of connectors 1 can be separated easily by rotating the lever 4. Thus, the connectors 2, 3 can be separated easily without damaging the lock arm 15 and the lock projection 26.

The release arm 37 of the first release member 34 of the interlocking release member 5 penetrates between the other end 16*b* of the lock arm 15 and the male connector 2, so that the engagement of the lock arm 15 and the lock projection 26 can be released easily.

The pushing portion 40 of the second release member 35 of the interlocking release member 5 pushes the operating plate 19 as the one end of the lock arm 15 moves toward the male connector 2, so that the engagement of the lock arm 15 and the lock projection 26 can be released easily.

The guide groove 6 for guiding the motion of the pushing portion 40 of the second release member 35 is provided at the operating plate 19 of the lock arm 15. Thereby, a direction of the rotation of the lever is guided by the pushing portion 40 of the second release member 35 and the guide groove 6. The pair of guide projections 7 locating the pushing portion 40 of the second release member 35 therebetween for guiding the motion of the pushing portion 40 of the second release member 35 is provided at the cover 10 of the male connector 2, on which the lever 4 is mounted. The direction of rotation of the lever 4 is guided by the pushing portion 40 of the second release member 35 and the pair of guide projections 7. Thereby, even if the mechanical strength of the lever 4 is reduced by miniaturizing the lever 4, the lever 4 will have no chances to be damaged. Therefore, the lever 4 can be more miniaturized.

Until the engagement of the lock arm 15 and the lock projection 26 is released, the space A makes the male connector 2 and the female connector 3 not move relative to each other. Thereby, before the engagement of the lock arm 15 and lock projection 26 is released when the connectors 2, 3 are separated, the connectors 2, 3 are prevented from moving to separate from each other, so that the lock arm 15 and the lock projection 26 can be prevented from damage. Therefore, the connectors 2, 3 can be separated easily without damage of the lock arm 15 and the lock projection 26.

The space A is provided between the inner wall 27*a* of the fitting guide groove 27 and the fitting guide projection 33. Until the engagement of the lock arm 15 and the lock projection 26 is released, the male connector 2 and the male connector 3 do not move relative to each other. Thereby, the connectors 2, 3 can be separated easily from each other without the damage of the lock arm and the lock projection 26.

Since the set of connectors 1 has the temporary lock 8, the lever 4 is prevented from rotating when the connectors 2, 3 are separated. Therefore, when the connectors 2, 3 are separated, it is prevented that the lever 4 is positioned at the second position to be positioned when the connectors 2, 3 are completely coupled.

In the aforesaid embodiment, the lever 4 is mounted on the male connector 2. According to the present invention, the lever 4 can be mounted on the female connector 3. In the embodiment, the lock arm 15 is provided at the male connector 2, on which the lever 4 is mounted, and the lock projection 26 is provided at the female connector 3, on which the lever 4 is not mounted. According to the present invention, the lock projection 26 can be provided at the male connector 2, on which the lever 4 is mounted, and the lock arm 15 can be provided at the female connector 3, on which the lever 4 is not mounted. In other words, according to the present invention, the lever 4 can be mounted on one of the connectors 2, 3, and (one of) the lock arm 15 (and the lock projection 26) can be provided at one of connectors 2, 3 and the other of the lock arm 15 (and the lock projection 26) can be provided at the other of connectors 2, 3.

In the above embodiment, the fitting guide projection 33 is provided at the lever 4 and the fitting guide groove 27 is provided at the female connector 3, which is the one of the connectors 2, 3, on which the lever 4 is not mounted. According to the present invention, the fitting projection 33 can be provided at one of connectors 2, 3, on which the lever 4 is not mounted, and the fitting guide groove 27 can be provided at the lever 4.

In the above embodiment, the interlocking release member 5 includes both the first release member 34 and the second release member 35. According the present invention, the interlocking release member 5 can include only the first release member 34 or only the second release member 35. In other words, according to the present invention, the interlocking release member 5 can include at least one of the first release member 34 and the second release member 35. Therefore, according to the present invention, the release arm 37 of the first release member 34 can be eliminated.

In the above embodiment, the temporary lock 8 includes the both of the first temporary lock 42 and the second temporary lock 43. According to the present invention, the temporary lock 8 can includes only the first temporary lock 42 or only the second temporary lock 43. In other words, according to the present invention, the temporary lock 8 can include at least one of the first temporary lock 42 and the second temporary lock 43. According to the present invention, the above guide groove 6 can be eliminated.

While the described embodiment represents the preferred form of the present invention, it is to be understood that the present invention is not limited thereto. Therefore, various change and modifications can be made with the scope of the present invention.

What is claimed is:

1. A set of connectors, comprising:

a first connector having a lock arm;

a second connector having a lock projection to be engaged with said lock arm upon coupling of the first and second connectors;

a lever provided on either one of the first connector and the second connector so as to rotate between coupled and uncoupled positions thus facilitating coupling and uncoupling between the first and second connectors;

an interlocking release member which releases engagement of the lock arm and the lock projection during rotation of the lever to the uncoupled position;

a fitting guide projection provided on the lever of the connector on which the lever is provided, and said fitting guide projection projects toward the other of the connectors;

a fitting guide groove, into which the fitting guide projection penetrates, provided on the other of the connectors, wherein the first connector and the second connector are moved in the coupling and uncoupling directions by movement of the fitting guide projection in the fitting guide groove when the lever is rotated; and a fitting hold spacing defined by the fitting guide projection and the fitting guide groove as a space between them, said fitting hold spacing between the fitting guide projection and the fitting guide groove being maintained until the interlocking release member releases the engagement of the lock arm and the lock projection during rotation of the lever to separate the first connector and the second connector from each other.

2. The set of connectors according to claim 1, further including a temporary lock provided for locking the lever when the first connector and the second connector are uncoupled, and the temporary lock is released when the first and second connectors approach each other when the first and second connectors are moved in the coupling direction.

3. A set of connectors, comprising:

a first connector having a lock arm;

a second connector having a lock projection to be engaged with said lock arm upon coupling of the first and second connectors;

a lever provided on either one of the first connector and the second connector so as to rotate between coupled and uncoupled positions thus facilitating coupling and uncoupling between the first and second connectors;

an interlocking release member which releases engagement of the lock arm and the lock projection during rotation of the lever to the uncoupled position;

a fitting guide projection provided on the lever of the connector on which the lever is provided, and said fitting guide projection projects toward the other of the connectors;

a fitting guide groove, into which the fitting guide projection penetrates, provided on the other of the connectors, wherein the first connector and the second connector are moved in the coupling and uncoupling directions by movement of the fitting guide projection in the fitting guide groove when the lever is rotated; and a fitting hold spacing defined by the fitting guide projection and the fitting guide groove as a space between them, said fitting hold spacing between the fitting guide projection and the fitting guide groove being maintained until the interlocking release member releases the engagement of the lock arm and the lock projection when the lever is rotated to separate the first connector and the second connector from each other, wherein the lock arm comprises a free end which engages the lock projection of the second connector;

the interlocking release member includes a first release member connected to and moveable by the lever which elastically deforms the lock arm releasing the engagement between the free end of the lock arm and the lock projection by penetrating between the first connector and the free end of the lock arm when the lever is rotated in a manner that separates the first connector and the second connector.

4. The set of connectors according to claim 3, further including a temporary lock provided for locking the lever when the first connector and the second connector are uncoupled, and the temporary lock is released when the first and second connectors approach each other when the first and second connectors are moved in the coupling direction.

5. The set of connectors according to claim 3, wherein the interlocking release member includes a second release member connected to and moveable by the lever which elastically deforms the lock arm releasing the engagement between the free end of the lock arm and the lock projection by pushing the free end of the lock arm connector when the lever is rotated in a manner that separates the first connector and the second connector.

6. The set of connectors according to claim 5, wherein the second release member includes a pushing portion projecting from the lever toward the lock arm, and a guide groove provided within the housing of the first connector which extends in a direction which parallels the coupling and uncoupling direction, the guide groove provides guiding motion to said pushing portion which penetrates into the guide groove when the lever is rotated in a manner that separates the first connector and the second connector.

7. A set of connectors, comprising:

a first connector having a lock arm;

a second connector having a lock projection to be engaged with said lock arm upon coupling of the first and second connectors;

a lever provided on either one of the first connector and the second connector so as to rotate between coupled and uncoupled positions thus facilitating coupling and uncoupling between the first and second connectors;

an interlocking release member which releases engagement of the lock arm and the lock projection during rotation of the lever to the uncoupled position;

a fitting guide projection provided on the lever of the connector on which the lever is provided, and said fitting guide projection projects toward the other of the connectors;

a fitting guide groove, into which the fitting guide projection penetrates, provided on the other of the connectors, wherein the first connector and the second connector are moved in the coupling and uncoupling directions by movement of the fitting guide projection in the fitting guide groove when the lever is rotated; and a fitting hold spacing defined by the fitting guide projection and the fitting guide groove as a space between them, said fitting hold spacing between the fitting guide projection and the fitting guide groove being maintained until the interlocking release member releases the engagement of the lock arm and the lock projection when the lever is rotated to separate the first connector and the second connector from each other, wherein the lock arm comprises a free end which engages the lock projection of the second connector;

the interlocking release member includes a second release member connected to and moveable by the lever which elastically deforms the lock arm releasing the engagement between the free end of the lock arm and the lock projection by pushing the free end of the lock arm away from the second connector when the lever is rotated in a manner that separates the first connector and the second connector.

8. The set of connectors according to claim 7, wherein either one of the first connector and the second connector, on which the lever is provided, further comprises a pair of guide projections extending in a direction which parallels the coupling and uncoupling directions the guide projection provides guiding motion to the second release member which includes a pushing portion which penetrates between the pair of guide projections when the lever is rotated in a manner that separates the first connector and the second connector.

9. The set of connectors according to claim 7, further including a temporary lock provided for locking the lever when the first connector and the second connector are uncoupled, and the temporary lock is released when the first and second connectors approach each other when the first and second connectors are moved in the coupling direction.

10. The set of connectors according to claim 7, wherein the second release member further includes a pushing portion projecting from the lever toward the lock arm;

a guide groove provided with the housing of the first connector extends in a direction which parallels the coupling and uncoupling direction, the guide groove provides guiding motion to said pushing portion which penetrates into the guide groove when the lever is rotated in a manner that separates the first connector and the second connector.

11. The set of connectors according to claim 10, wherein either one of the first connector and the second connector, on which the lever is provided, further comprises a pair of guide projections extending in a direction which parallels the coupling and uncoupling directions, the guide projection provides guiding motion to said pushing portion which penetrates between the pair of guide projections when the lever is rotated.

* * * * *